US007798891B2

(12) United States Patent
Stubbert et al.

(10) Patent No.: US 7,798,891 B2
(45) Date of Patent: Sep. 21, 2010

(54) CHIMNEY LINING AND VENTING APPARATUS FOR USE WITH EMISSIONS FROM AN APPLIANCE, AND METHOD OF ASSEMBLY

(75) Inventors: Bernard Franklin Stubbert, Campbellville (CA); Gerald D. Nicholls, Hampton (CA)

(73) Assignee: Don Park Limited Partnership, Toronto (CA)

( * ) Notice: Subject to any disclaimer, the term of this patent is extended or adjusted under 35 U.S.C. 154(b) by 259 days.

(21) Appl. No.: 12/020,514

(22) Filed: Jan. 25, 2008

(65) Prior Publication Data

US 2008/0254729 A1 Oct. 16, 2008

Related U.S. Application Data

(60) Provisional application No. 60/911,272, filed on Apr. 11, 2007.

(51) Int. Cl.
*F23J 13/02* (2006.01)

(52) U.S. Cl. ..... 454/44; 454/47; 454/35; 454/3; 126/312; 126/316; 126/318; 285/123.15

(58) Field of Classification Search ..... 454/44, 454/45, 46, 47, 35, 3; 126/316, 312, 315, 126/318; 138/167, 168, 129; 285/140, 123.15
See application file for complete search history.

(56) References Cited

U.S. PATENT DOCUMENTS 1,528,252 A * 3/1925 House ..... 285/179.2
4,099,747 A * 7/1978 Meserole ..... 285/148.15
4,160,559 A * 7/1979 Nickels, Jr. ..... 285/133.5
4,306,491 A * 12/1981 Reardon, Jr. ..... 454/12
4,846,147 A * 7/1989 Townsend et al. ..... 126/307 R
5,253,636 A * 10/1993 Glover et al. ..... 126/299 R
5,393,260 A * 2/1995 Barth ..... 454/44
5,494,319 A * 2/1996 Thomas ..... 285/55
6,588,802 B2 * 7/2003 Schukal ..... 285/133.11
7,119,275 B2 * 10/2006 Suzuki et al. ..... 174/503
7,347,224 B2 * 3/2008 Nohara et al. ..... 138/109
2003/0230895 A1 * 12/2003 Brown et al. ..... 285/239
2004/0160057 A1 * 8/2004 Barnoff ..... 285/133.11

(Continued)

OTHER PUBLICATIONS

Ventinox Instructions, Dura Vent, 2004.*

(Continued)

*Primary Examiner*—Steven B McAllister
*Assistant Examiner*—Brittany Towns
(74) *Attorney, Agent, or Firm*—Lang Michener LLP

(57) ABSTRACT

A venting apparatus includes a projecting member with a projection base, and a mating socket member with a socket base, and first and second ducts in fluid communication with an appliance to vent emissions along an emission flow path. The projection base engages a first one, and the socket base engages a respective other one, of the first and second ducts. The projecting and socket members have default configurations. The projecting member is movable from the default configuration towards a deflected configuration, and biased for return therefrom. The first and second ducts are movable between sliding and locked configurations. In the sliding configuration, the projecting and socket members bear against one another, with the projecting member removed from the default configuration. In the locked configuration, the projecting member is in the default configuration, and secured to the socket member, such that the second duct securely engages the first duct.

48 Claims, 14 Drawing Sheets

U.S. PATENT DOCUMENTS

| | | | | |
|---|---|---|---|---|
| 2005/0229923 | A1* | 10/2005 | Barry et al. | 126/312 |
| 2006/0121841 | A1* | 6/2006 | Arbucci | 454/3 |
| 2008/0220709 | A1* | 9/2008 | Meredith | 454/44 |

OTHER PUBLICATIONS

Snap-Lock Adaptor, DuraVent Catalog,2008.*

Don Park Limited Partnership, Product Catalogue, Jan. 2006, p. 22, Toronto, Canada.

Magnaflex, Flexible Stainless Venting System, Mar. 1997, Pickering Canada.

Royal Chimney Supply, Flex-King(TM) Catalogue, 2004, Madison Twp, PA.

Trans Continental Equipment LTD., Chimneyflexible Catalogue(TM), 2000, Oshawa, Canada.

* cited by examiner

CHIMNEY LINING AND VENTING APPARATUS FOR USE WITH EMISSIONS FROM AN APPLIANCE, AND METHOD OF ASSEMBLY

FIELD OF THE INVENTION

The present invention relates to the field of chimney lining systems, and more particularly to a chimney lining and venting apparatus for use with emissions from an appliance, and associated methods of assembly, as well as to components thereof.

BACKGROUND OF THE INVENTION

Lining and venting apparatuses are often used with chimneys to vent emissions from appliances therethrough. Such lining and venting systems are often connected, directly or indirectly, to the appliance creating the emissions that must be vented through the chimney. Such appliances may include, for example and without limitation, various types of furnaces and stoves. In some prior art systems, flexible liners have been operatively positioned within the chimney, and have been connected at their bottom end to a fitting. Such fittings have been provided with snouts integral or attached thereto that connect with an extension branch that connects to the appliance (or to a duct that leads thereto). Such extension branches can be quite lengthy and can be just one of multiple components connecting the snout to the appliance; even in instances of single extension branches they can be in excess of four feet in length.

It is known in the art to provide fittings that are attachable to the extension branches via the use of fasteners including, for example, screws, and rivets. Fastening of extension branches to fittings (or, indeed, any lining system components to be so fastened) by such means has been quite labor intensive, and can, in some instances, increased the incidence of corrosion and thereby undermine the integrity of the system.

Moreover, attachment of extension branches to the liner after the liner is drawn into the chimney is relatively difficult, insofar as the use of unwieldy implements is required when working with prior art systems. The extension branches must be connected to the snouts in a relatively snug fashion. Given the generally cramped size of the workspace, this can be quite difficult.

In addition, the length of the branch connected to the snout or fitting can make it exceedingly difficult to access the end of which such a connection is made. That is, the interface between the snout and the branch may be inaccessible, other then from the far end of the branch. It is desirable to provide extension branches and snouts (or fittings, if snouts are not employed) with a means of connecting same without need of much labour, and excessive manipulation on the part of a technician installing or maintaining same.

Similarly laborious means of connection have been provided in the prior art for connection of snouts to fittings, and of the liner to the fitting. In this latter instance, there is a high risk of perforation of the liner, and resulting corrosion of the fasteners employed in such applications, and, perhaps, leakage of gases. As such, it is also desirable to employ similarly improved connections in these additional areas of the chimney lining system.

With respect to the interface between the liner and the fitting, each has been typically provided having a substantially smooth surface to interact with alike smooth surface on the other. That is, a seal is effected merely by way of compression of the two together (as occurs, for example, when screws are tightened), rather than by any more sophisticated interaction. It is desirable to provide more contoured surfaces of the fitting and the liner, so as to facilitate a seal being effected therebetween (and/or at the interface thereof by engagement of a non-puncturing fastener).

It is also known in the art to attach vent caps over the upper end of the flexible liner, whereat the gases escape from the liner. Sadly, vent caps employed in the prior art often permitted water to run—generally down the outside of the flexible liner—into the chimney cavity, which resulted in increased incidence of deterioration of materials therein. Moreover, engagement of the vent cap with the top of the liner has typically been effected by way of the conventional fasteners (e.g., screws, etc.) discussed above, with similar problem to those discussed above being encountered. As such, it is desirable to provide a vent cap incorporating a means of deflecting water and, perhaps, objects from being allowed to run down the liner, and even from running down the side of or aside the liner into the chimney.

Attempts have been made, without success, to overcome the aforementioned problems. For example, some previous methods may have attempted to utilize relatively standard pipe-type fittings, e.g., with drawbands, clips and/or screws having been borrowed directly from the piping field, and misapplied, without any necessary adaptations, to the field of chimney liner systems so as to hold the fittings to the liner, the liner to the vent cap, the fittings to the snout, and the snout to the branch. In another example of a past failure to overcome the aforementioned problems, some may have tried to utilize a form of twist-lock mechanism for engagement of the tee to the extension.

There exists, therefore, an ongoing need for apparatuses for use with or as part of chimney lining systems that over come the foregoing disadvantages.

It is an object of an aspect of one preferred embodiment of the present invention to provide fastening devices to be built into some of the components of the apparatuses that are actuated by interaction of the components together, rather than by way of the use of hand tools to connect all the components.

It is an object of an aspect of one preferred embodiment of the present invention to provide fasteners built into the profile of the some of the components thereof, so as to reduce the amount of labor which might otherwise be required during installation and/or servicing of the apparatuses of the present invention.

It is an object of an aspect of one preferred embodiment of the present invention to provide means of fastening to a flexible liner that do not involve penetration thereof.

It is an object of an aspect of one preferred embodiment of the present to provide a tee branch that may, but need not necessarily, be nested within the interior of the tee during installation, so as to substantially eliminate and/or significantly reduce obstructions during installation.

It is an object of an aspect of one preferred embodiment of the present invention top provide a base tee member that snaps into its installed position easily once the flexible liner is in place.

It is an object of an aspect of one preferred embodiment of the present invention to provide a first duct that attaches to a second duct, preferably so as to reduce or remove the need for tools.

It is an object of an aspect of one preferred embodiment of the present invention to provide a flashing member with a collar into which a vent cap easily fits in sliding relation.

It is an object of an aspect of one preferred embodiment of the present invention to provide an inner skirt of the vent cap that may preferably, but need not necessarily, channel water into an interior of the flexible liner, preferably instead of allowing the water to run uncontrolled into the chimney cavity.

It is an object of an aspect of one preferred embodiment of the present invention to provide a vent cap that is held in place by a single may preferably, but need not necessarily, be held in place with a simple finger tip clip.

It is an object of an aspect of one preferred embodiment of the present invention to provide for a much stronger grip of the fittings onto the flexible liner, preferably so as to eliminate or significantly reduce the potential that such fittings may slip-off during installation, servicing, and/or general use.

It is an object of an aspect of one preferred embodiment of the present invention to provide the second duct in a configuration adapted to fit within the flexible liner, preferably so as to eliminate or significantly reduce the potential of "hanging-up" within the chimney during installation.

It is an object of an aspect of one preferred embodiment of the present invention to provide a ratchet clamp that may lock the flashing collar and the flexible liner securely into place, preferably so as to provide a substantially solid foundation point where the vent cap may preferably, but need not necessarily, be slipped into place and fastened down (preferably with a bendable anchor tab).

It is an object of an aspect of one preferred embodiment of the invention to achieve one or more of the aforementioned objects of the invention and/or to overcome, obviate, mitigate and/or traverse one or more of the aforementioned problems and/or disadvantages associated with the prior art.

SUMMARY OF THE INVENTION

In accordance with the present invention, there is disclosed a chimney lining apparatus for use with a chimney and emissions from an appliance. The chimney lining apparatus including a venting assembly, a base tee member, and a flexible liner. The venting assembly includes a first duct, a second duct, a first projecting member, and a mating first socket member. The first duct is in fluid communication with the appliance to vent the emissions from the appliance along an emission flow path. The first duct defines an outlet axis. The second duct is positioned in fluid communication with, and in substantially direct downstream relation along the emission flow path from, the first duct. The second duct defines an inlet axis. The first projecting member is provided with a first projection base, and the mating first socket member is provided with a first socket base. The first projection base securely engages a projecting first one, and the first socket base securely engages a socket respective other one, of the first duct and the second duct. Each one of the first projecting member and the first socket member has a respective default configuration. At least one of the first projecting member and the first socket member is operatively designed for movement from its default configuration towards a deflected configuration, and biased for return therefrom towards its default configuration. The first duct and the second duct are together movable between a slidably engaging configuration and a locked configuration. In the slidably engaging configuration, the first projecting member and the first socket member bear against one another, such that the aforesaid at least one of the first projecting member and the first socket member is removed from its default configuration towards the deflected configuration. In the locked configuration, the first projecting member and the first socket member are each in the default configuration, with the first projecting member securely and matingly engaging the first socket member. As such, the second duct operatively and securely engages the first duct, with the outlet axis being substantially co-axial with the inlet axis and operatively oriented substantially along the emission flow path, to vent the emissions from the appliance downstream of the venting assembly. The base tee member operatively engages the second duct in the aforesaid fluid communication, with the base tee member being in substantially direct downstream relation along the emission flow path from the second duct. The flexible liner operatively engages the base tee member in the aforesaid fluid communication, with the flexible liner being in substantially direct downstream relation along the emission flow path from the base tee member. Each one of the base tee member and the flexible liner has a respective exterior surface, and is operatively positioned within the chimney. The emissions from the venting assembly are operatively vented, downstream along the emission flow path, through the base tee member and the flexible liner, to outside of the chimney lining apparatus.

According to one aspect of a preferred embodiment of the invention, the base tee member has a base top end portion and the flexible liner has a liner bottom end portion. The apparatus also includes a liner base locking device to operatively secure the base top end portion to the liner bottom end portion in substantially sealed relation.

According to one aspect of a preferred embodiment of the invention, the liner base locking device includes a locking clamp operatively positioned about a sealing first one of the base top end portion and the liner bottom end portion. The locking clamp operatively compresses the sealing first one, into the aforesaid substantially sealed relation, against a sealing respective other one of the base top end portion and the liner bottom end portion.

According to one aspect of a preferred embodiment of the invention, the aforesaid sealing first one is the liner bottom end portion and the aforesaid sealing respective other one is the base top end portion. The locking clamp is operatively positioned about the exterior surface of the flexible liner. The liner bottom end portion is operatively positioned about the exterior surface of the base tee member.

According to one aspect of a preferred embodiment of the invention, the locking clamp is a screw clamp.

According to one aspect of a preferred embodiment of the invention, the liner base locking device includes a base lock upper edge portion. The base lock upper edge portion is provided with an upper base lip member operatively secured to the liner bottom end portion in the aforesaid substantially sealed relation.

According to one aspect of a preferred embodiment of the invention, the flexible liner is shaped to define a helical first one, and the upper base lip member is shaped to define a helical respective other one, selected from the group consisting of a helical ridge and a mating helical groove. The helical first one extends about the exterior surface of the flexible liner. The base lock upper edge portion is operatively positioned about the exterior surface of the flexible liner, with the aforesaid helical respective other one matingly engaging, and being operatively secured to, the aforesaid helical first one in the aforesaid substantially sealed relation.

According to one aspect of a preferred embodiment of the invention, the aforesaid helical first one is the helical groove, and the aforesaid helical respective other one is the helical ridge.

According to one aspect of a preferred embodiment of the invention, the liner base locking device includes a base lock lower edge portion. The base lock lower edge portion is operatively secured to the base top end portion in the aforesaid substantially sealed relation.

According to one aspect of a preferred embodiment of the invention, the base tee member is shaped to define a first bead circumscribing the base top end portion, and the liner base locking device is shaped to define a mating second bead circumscribing the base lock lower edge portion. The base lock lower edge portion is operatively positioned about the exterior surface of the base tee member, with the first bead matingly engaging, and being operatively secured to, the second bead in the aforesaid substantially sealed relation.

According to one aspect of a preferred embodiment of the invention, the first bead extends in a substantially outward direction from the exterior surface of the base tee member. The liner base locking device has an interior surface. The second bead is formed as a depression in the interior surface of the liner base locking device substantially adjacent to the base lock lower edge portion.

According to one aspect of a preferred embodiment of the invention, the base tee member has a base bottom end portion defining a base bottom aperture therethrough. The apparatus also includes a cleanout cap operatively occluding the base bottom aperture, and a cap locking fastener to operatively secure the cleanout cap to the base bottom end portion in readily releasable relation.

According to one aspect of a preferred embodiment of the invention, the cap locking fastener includes a releasable joiner band operatively positioned about a securing first one of the base bottom end portion and the cleanout cap. The releasable joiner band operatively compresses the securing first one, into the aforesaid readily releasable relation, against a securing respective other one of the base bottom end portion and the cleanout cap.

According to one aspect of a preferred embodiment of the invention, the aforesaid securing first one is the cleanout cap and the aforesaid securing respective other one is the base bottom end portion. The cleanout cap has an exterior cap surface. The releasable joiner band is operatively positioned about the exterior cap surface.

According to one aspect of a preferred embodiment of the invention, the apparatus also includes a cap handle extending from the cleanout cap to facilitate ready removal of the cleanout cap from the base bottom end portion.

According to one aspect of a preferred embodiment of the invention, the base tee member has a base sidewall portion defining a base side aperture therethrough. The second duct and the base tee member are together adapted for movement between a proving configuration and an operative configuration. In the proving configuration, the second duct is nested within the base tee member. In the operative configuration, the second duct securely engages and operatively extends from the base sidewall portion, with the base side aperture being in the aforesaid fluid communication and in the aforesaid substantially direct downstream relation along the emission flow path from the second duct. As such, the emissions from the venting assembly are operatively vented, downstream along the emission flow path, from the second duct, through the base side aperture, and into the base tee member.

According to one aspect of a preferred embodiment of the invention, the apparatus also includes a base branch locking device to secure the second duct to the base sidewall portion in the operative configuration.

According to one aspect of a preferred embodiment of the invention, the base branch locking device is securely attached to a first locking one, and securely engagable in the operative configuration with a respective other locking one, of the group consisting of the second duct and the base sidewall portion.

According to one aspect of a preferred embodiment of the invention, the first locking one is the second duct, and the respective other locking one is the base sidewall portion.

According to one aspect of a preferred embodiment of the invention, the base branch locking device includes a resilient first locking tab member that is resiliently deformable from a first default tab configuration towards a first deflected tab configuration, and biased for resilient return therefrom towards the first default tab configuration. The first locking tab member is provided with a first bearing tab surface and a first locking tab surface substantially adjacent to the first bearing tab surface. During movement between the proving configuration and the operative configuration, the first bearing tab surface slidably engages the respective other locking one, such that the first locking tab member is removed from the first default tab configuration towards the first deflected tab configuration. In the operative configuration, the first locking tab member is in the first default tab configuration, and the first locking tab surface securely and matingly engages the respective other locking one. As such, movement of the second duct relative to the base sidewall portion is substantially restrained in at least a first branch direction substantially parallel to the emission flow path.

According to one aspect of a preferred embodiment of the invention, the first branch direction extends generally in the downstream direction.

According to one aspect of a preferred embodiment of the invention, the base branch locking device further includes a resilient second locking tab member that is resiliently deformable from a second default tab configuration towards a second deflected tab configuration, and biased for resilient return therefrom towards the second default tab configuration. The second locking tab member is provided with a second bearing tab surface and a second locking tab surface substantially adjacent to the second bearing tab surface. During movement between the proving configuration and the operative configuration, the second bearing tab surface slidably engages the respective other locking one, such that the second locking tab member is removed from the second default tab configuration towards the second deflected tab configuration. In the operative configuration, the second locking tab member is in the second default tab configuration, and the second locking tab surface securely and matingly engages the respective other locking one. As such, movement of the second duct relative to the base sidewall portion is substantially restrained in at least the first branch direction.

According to one aspect of a preferred embodiment of the invention, the apparatus also includes a stop branch member provided on a first base branch one, and securely engagable in the operative configuration with a respective other base branch one, of the group consisting of the base tee member and the second duct. A such, in the operative configuration, the stop branch member operatively restrains movement of the second duct relative to the base sidewall portion in at least a second branch direction substantially opposed to the first branch direction.

According to one aspect of a preferred embodiment of the invention, the first base branch one is the second duct, and the respective other base branch one is the base tee member.

According to one aspect of a preferred embodiment of the invention, the flexible liner has a liner top end portion. The apparatus also includes a flashing member and a liner top locking device. The flashing member is securely engagable with the chimney and has a flashing top portion and an inside flashing edge shaped to define a flashing aperture through the flashing member. The flashing top portion includes a secure flashing collar substantially adjacent to the inside flashing edge. The liner top end portion operatively extends through the flashing aperture, such that the flashing member is operatively positioned in generally downstream relation from the base tee member. The liner top locking device includes a locking top clamp, a top lock upper edge portion, and a top lock lower edge portion. The locking top clamp is operatively positioned about the secure flashing collar, and compresses the secure flashing collar against the liner top end portion. The top lock upper edge portion is provided with an upper top lip member operatively secured to the liner top end portion. The top lock lower edge portion operatively engages the flashing top portion. As such, the liner top locking device operatively secures the liner top end portion to the flashing member.

According to one aspect of a preferred embodiment of the invention, the locking top clamp is a ratchet clamp.

According to one aspect of a preferred embodiment of the invention, the flexible liner is shaped to define a first helical top one, and the upper top lip member is shaped to define a respective other helical top one, selected from the group consisting of a helical top ridge and a mating helical top groove. The first helical top one extends about the exterior surface of the flexible liner. The top lock upper edge portion is operatively positioned about the exterior surface of the flexible liner, with the aforesaid respective other helical top one matingly engaging, and being operatively secured to, the aforesaid first helical top one.

According to one aspect of a preferred embodiment of the invention, the aforesaid first helical top one is the helical top groove, and the aforesaid respective other helical top one is the helical top ridge.

According to one aspect of a preferred embodiment of the invention, the top lock lower edge portion is operatively secured to the flashing top portion.

According to one aspect of a preferred embodiment of the invention, the secure flashing collar is shaped to define a first top bead at least partially circumscribing the inside flashing edge. The liner top locking device is shaped to define a mating second top bead at least partially circumscribing the top lock lower edge portion. The top lock lower edge portion is operatively positioned about the secure flashing collar, with the first top bead matingly engaging, and being operatively secured to, the second top bead.

According to one aspect of a preferred embodiment of the invention, the first top bead is formed as a top projection extending in a substantially outward direction from the secure flashing collar. The liner top locking device has an interior top locking surface. The second top bead is formed as a depression in the interior top locking surface substantially adjacent to the top lock lower edge portion.

According to one aspect of a preferred embodiment of the invention, the flashing top portion is operatively positioned substantially outside, and in substantially sealing relation with, the chimney.

According to one aspect of a preferred embodiment of the invention, the apparatus also includes a vent cap having an upper shield, an outer cap surface, and an inner skirt. The outer cap surface is operatively positioned outside of the liner top locking device. The inner skirt operatively engages, and extends to inside of, the liner top end portion. The vent cap is in the aforesaid fluid communication and in substantially direct downstream relation along the emission flow path from the flexible liner. The upper shield partially shields a top emission outlet in the liner top end portion from environmental precipitation and permits the emissions to be operatively vented, through the vent cap, to outside of the chimney and chimney lining apparatus. The precipitation impinging upon the vent cap is operatively substantially directed towards at least one of an inside of the flexible liner and across the flashing top portion.

According to one aspect of a preferred embodiment of the invention, the apparatus also includes a projecting cap locking member provided on a first cap locking one, and a mating socket cap locking member provided on a respective other cap locking one, of the vent cap and the liner top locking device. The projecting cap locking member is operatively secured to the mating socket cap locking member, such that the vent cap is operatively secured to the liner top locking device.

According to one aspect of a preferred embodiment of the invention, the projecting cap locking member includes a bendable anchor tab. The mating socket cap locking member includes a hat cap locking bracket. The bendable anchor tab extends through and is bent over, so as to securely engage, the hat cap locking bracket.

According to one aspect of a preferred embodiment of the invention, the first cap locking one is the vent cap, and the respective other cap locking one is the liner top locking device.

In accordance with the present invention, there is also disclosed a venting apparatus for use with emissions from an appliance. The venting apparatus includes a first duct, a second duct, a first projecting member, and a mating first socket member. The first duct is in fluid communication with the appliance to vent the emissions from the appliance along an emission flow path. The first duct defines an outlet axis. The second duct is positioned in fluid communication with, and in substantially direct downstream relation along the emission flow path from, the first duct. The second duct defines an inlet axis. The first projecting member is provided with a first projection base, and the mating first socket member is provided with a first socket base. The first projection base securely engages a projecting first one, and the first socket base securely engages a socket respective other one, of the first duct and the second duct. Each one of the first projecting member and the first socket member has a respective default configuration. At least one of the first projecting member and the first socket member is operatively designed for movement from its default configuration towards a deflected configuration, and biased for return therefrom towards its default configuration. The first duct and the second duct are together movable between a slidably engaging configuration and a locked configuration. In the slidably engaging configuration, the first projecting member and the first socket member bear against one another, such that the aforesaid at least one of the first projecting member and the first socket member is removed from its default configuration towards the deflected configuration. In the locked configuration, the first projecting member and the first socket member are each in the default configuration, with the first projecting member securely and matingly engaging the first socket member. As such, the second duct operatively and securely engages the first duct, with the outlet axis being substantially co-axial with the inlet axis and operatively oriented substantially along the emission flow path, to vent the emissions from the appliance downstream of the venting apparatus.

According to one aspect of a preferred embodiment of the invention, each one of the first duct and the second duct has a mating portion. The mating portion of the first duct is oriented at a downstream end portion thereof. The mating portion of the second duct is oriented at an upstream end portion thereof and securely engages the mating portion of the first duct. The first projection base securely engages the mating portion of the projecting first one, and the first socket base securely engages the mating portion of the socket respective other one.

According to one aspect of a preferred embodiment of the invention, the first socket member includes a hat bracket. The aforesaid at least one of the first projecting member and the first socket member is the first projecting member. The first projecting member includes an anchor member that extends at least partially through, and into secure engagement with, the hat bracket.

According to one aspect of a preferred embodiment of the invention, the hat bracket includes a hat back wall and two hat side walls extending from the hat back wall. The hat back wall and the two hat side walls are together shaped to define a substantially U-shaped hat bracket profile. The hat side walls together form the first socket base. The anchor member extends between the hat side walls into secure engagement with the hat top wall.

According to one aspect of a preferred embodiment of the invention, the first projecting member includes a movable portion extending from substantially adjacent to the first projection base. The movable portion is movable relative to the first projection base between the default configuration and the deflected configuration. The movable portion is provided with a bearing surface and a locking surface substantially adjacent to the bearing surface. In the slidably engaging configuration, the bearing surface slidably engages the socket member, such that the movable portion is operatively removed from the default configuration towards the deflected configuration. In the locked configuration, the movable portion is in the default configuration, and the locking surface securely and matingly engages the first socket member. As such, movement of the first socket member relative to the projecting member is substantially restrained in at least a first restraining direction substantially parallel to the emission flow path.

According to one aspect of a preferred embodiment of the invention, the movable portion is resiliently deformable from the default configuration towards the deflected configuration, and biased for resilient return therefrom towards its the aforesaid default configuration.

According to one aspect of a preferred embodiment of the invention, the apparatus also includes a stop member provided on a first selected one of the group consisting of the first projecting member, the first socket member, the projecting first one, and the socket respective other one. The stop member engages the first projecting member and/or the projecting first one when the first selected one is the first socket member or the socket respective other one. The stop member engages the first socket member and/or the socket respective other one when the first selected one is the first projecting member or the projecting first one. As such, in the locked configuration, the stop member operatively restrains movement of the first socket member relative to the first projecting member in at least a second restraining direction substantially opposed to the first restraining direction.

According to one aspect of a preferred embodiment of the invention, the first selected one is the projecting first one, and the stop member engages the socket respective other one.

According to one aspect of a preferred embodiment of the invention, the movable portion extends at a projecting angle relative to the first projection base, with the projecting angle being of a greater magnitude in the default configuration than in the deflected configuration.

According to one aspect of a preferred embodiment of the invention, each one of the first duct and the second duct has an interior surface and an exterior surface. The first projection base securely engages the exterior surface of the projecting first one. The first socket base securely engages the exterior surface of the socket respective other one.

According to one aspect of a preferred embodiment of the invention, each one of the first duct and the second duct has an interior surface and an exterior surface. The first projection base securely engages the interior surface of the projecting first one. The first socket base securely engages the interior surface of the socket respective other one.

According to one aspect of a preferred embodiment of the invention, the apparatus also includes a second projecting member and a mating second socket member. The second projecting member is provided with a second projection base that securely engages the projecting first one. The mating second socket member is provided with a second socket base that securely engages the socket respective other one. At least one of the second projecting member and the second socket member is operatively designed for movement from its default configuration towards the deflected configuration, and biased for return therefrom towards its default configuration. In the slidably engaging configuration, the second projecting member and the second socket member bear against one another, such that the aforesaid at least one of the second projecting member and the second socket member is removed from its default configuration towards the deflected configuration. In the locked configuration, the second projecting member and the second socket member are each in the default configuration, with the second projecting member securely and matingly engaging the second socket member.

According to one aspect of a preferred embodiment of the invention, the projecting first one is the first duct, and the socket respective other one is the second duct.

In accordance with the present invention, there is also disclosed a method of venting emissions from an appliance. The method includes a first connecting step, a second connecting step, and a first pre-assembly step before the second connecting step. In the first connecting step, a first duct is connected, in fluid communication, to the appliance. As such, the first duct is adapted to vent the emissions from the appliance along an emission flow path. In the second connecting step, a second duct is connected, in said fluid communication, to the first duct. As such, the second duct is in substantially direct downstream relation, and is adapted to vent the emissions, from the first duct along the emission flow path. Before the second connecting step, a first projection base of a first projecting member securely engages a projecting first one, and a first socket base of a mating first socket member securely engages a socket respective other one, of the first duct and the second duct. Before the second connecting step, each one of the first projecting member and the first socket member is in a respective default configuration. In the first pre-assembly step, at least one of the first projecting member and the first socket member is made movable from its aforesaid default configuration towards a deflected configuration, and biased for return therefrom towards its aforesaid default configuration. In the second connecting step, the first duct and the second duct together move from a slidably engaging configuration towards a locked configuration. In the slidably engaging configuration, the first projecting member and the first socket member bear against one another. As such, said at least one of the first projecting member and the first socket member is removed from its said default configuration towards the deflected configuration. In the locked configuration, the first projecting member and the first socket member are each in the default configuration. The first projecting member securely and matingly engages the first socket member. As such, the second duct operatively and securely engages the first duct. An outlet axis of the first duct is substantially co-axial with an inlet axis of the second duct, and operatively oriented substantially along the emission flow path. The emissions from the appliance are vented downstream of the second duct.

According to one aspect of a preferred embodiment of the invention, the second connecting step is performed before the first connecting step.

According to one aspect of a preferred embodiment of the invention, a base tee member and a flexible liner are positioned within a chimney. The method additionally includes a base tee connecting step before the first connecting step, and a liner connecting step. In the base tee connecting step, the base tee member is connected, in fluid communication, to the second duct. As such, the base tee member is in substantially direct downstream relation, and is adapted to vent the emissions, from the second duct along the emission flow path. In the liner connecting step, the flexible liner is connected, in fluid communication, to the base tee member. As such, the flexible liner is in said substantially direct downstream relation, and is adapted to vent the emissions, from the base tee member along the emission flow path.

According to one aspect of a preferred embodiment of the invention, the liner connecting step is performed before the base tee connecting step.

According to one aspect of a preferred embodiment of the invention, the method also includes a base locking step of securing a base top end portion of the base tee member to a finer bottom end portion of the flexible liner in substantially sealed relation. In the base locking step, a base lock body that is provided with a screw clamp is operatively positioned about, and compresses, the liner bottom end portion into said substantially sealed relation against the base top end portion.

According to one aspect of a preferred embodiment of the invention, in the base locking step, a helical ridge extending about an upper edge portion of the base lock body is positioned about an exterior surface of the flexible liner, and matingly and securely engages a mating helical groove extending about the liner bottom end portion in substantially sealed relation.

According to one aspect of a preferred embodiment of the invention, in the base locking step, a first bead circumscribing the base top end portion matingly and securely engages a second bead circumscribing a base lock lower edge portion of the base lock body in substantially sealed relation.

According to one aspect of a preferred embodiment of the invention, in the base tee connecting step, the second duct and the base tee member are together moved from a proving configuration towards an operative configuration. In the proving configuration, the second duct is nested within the base tee member. In the operative configuration, the second duct securely engages and operatively extends from a base sidewall portion of the base tee member. A base side aperture through the base sidewall portion is in fluid communication with, and in substantially direct downstream relation along the emission flow path, from the second duct. As such, the base tee member is adapted to receive the emissions from the second duct through the base side aperture.

According to one aspect of a preferred embodiment of the invention, before the base locking step, a resilient locking tab member is securely attached to the second duct, with the locking tab member being in a default tab configuration. The method also includes a tab pre-assembly step, before the base locking step, of making the locking tab resiliently deformable from the default tab configuration towards a deflected tab configuration, and biased for resilient return therefrom towards the default tab configuration. In the base locking step, during movement between the proving configuration and the operative configuration, a bearing tab surface of the locking tab member slidably engages the base sidewall portion. As such, the locking tab member is resiliently deformed from the default tab configuration towards the deflected tab configuration. In the operative configuration, the locking tab member is in the default tab configuration. A locking tab surface of the locking tab member securely and matingly engages the base sidewall portion, so as to substantially restrain movement of the second duct relative to the base tee member in at least a first branch direction.

According to one aspect of a preferred embodiment of the invention, in the operative configuration, a stop branch member of the second duct securely engages the base sidewall portion, such as to substantially restrain movement of the second duct relative to the base tee member in at least a second branch direction substantially opposed to the first branch direction.

According to one aspect of a preferred embodiment of the invention, the method also includes a flashing insertion step and a liner top locking step. In the flashing insertion step, a liner top end portion of the flexible liner is inserted through a flashing aperture of a flashing member. The flashing member is adapted for secure engagement with the chimney. In the liner top locking step, the liner top end portion operatively secures to the flashing member. In the liner top locking step, a top lock body having a locking top clamp is portioned about, and compresses, a secure flashing collar of the flashing member against the liner top end portion. In the liner top locking step, an upper top lip member of the top lock body is secured to the liner top end portion, with a top lock lower edge portion engaging the flashing top member.

According to one aspect of a preferred embodiment of the invention, in the liner top locking step, a top ridge provided on the upper top lip member extends about the top lock upper edge portion, and matingly and securely engages a mating top groove extending about the liner top end portion.

According to one aspect of a preferred embodiment of the invention, in the liner top locking step, the top lock lower edge portion is operatively secured to the secure flashing collar. A first top bead at least partially circumscribes the secure flashing collar. The first top bead matingly and securely engages a mating second top bead at least partially circumscribing the top lock lower edge portion.

According to one aspect of a preferred embodiment of the invention, the method also includes a vent cap securing step of positioning an outer cap surface of a vent cap member outside of the top lock body. In the vent cap securing step, an inner skirt of the vent cap engages, and extends to inside of, the liner top end portion. As such, the vent cap is in fluid communication with, and substantially direct downstream relation along the emission flow path from, the flexible liner. As such, the vent cap is adapted to direct environmental precipitation impinging upon the vent cap towards an inside of the flexible liner and/or across the flashing top portion.

According to one aspect of a preferred embodiment of the invention, in the vent cap securing step, a bendable anchor tab on the top lock body extends through and is bent over, so as to securely engage, a hat cap locking bracket on the vent cap.

According to one aspect of a preferred embodiment of the invention, in the second connecting step, an anchor member of the first projecting member extends at least partially through, and into secure engagement with, a hat bracket of the first socket member.

According to one aspect of a preferred embodiment of the invention, in the second connecting step, a movable portion of the first projecting member moves, relative to the projection base, between the default configuration and the deflected configuration. In the slidably engaging configuration, a bearing surface of the movable portion slidably engages the first socket member, such that the movable portion is removed from the default configuration towards the deflected configuration. In the locked configuration, the movable portion is in the default configuration. A locking surface of the first projecting member securely and matingly engages the first socket member, so as to restrain movement of the first socket member relative to the first projecting member in at least a first restraining direction.

According to one aspect of a preferred embodiment of the invention, the method also includes a projection pre-assembly step, before the second connecting step, of making the movable portion resiliently deformable from the default configuration towards the deflected configuration, and biased for resilient return therefrom towards its said default configuration.

According to one aspect of a preferred embodiment of the invention, in the locked configuration of the second connecting step, a stop member on the projecting first one engages the socket respective other one, so as to restrain movement of the first socket member relative to the first projecting member in at least a second restraining direction substantially opposed to the first restraining direction.

According to one aspect of a preferred embodiment of the invention, before the second connecting step, a second projection base of a second projecting member securely engages the projecting first one. A second socket base of a mating second socket member securely engages the socket respective other one. Before the second connecting step, each one of the second projecting member and the second socket member is in the default configuration. In the first pre-assembly step, at least one of the second projecting member and the second socket member is made movable from the default configuration towards the deflected configuration, and biased for return therefrom towards the default configuration. In the slidably engaging configuration, the second projecting member and the second socket member bear against one another, such that said at least one of the second projecting member and the second socket member is removed from the default configuration towards the deflected configuration. In the locked configuration, the second projecting member and the second socket member are each in the default configuration, with the second projecting member securely and matingly engaging the second socket member.

According to one aspect of a preferred embodiment of the invention, the projecting first one is the first duct, and the socket respective other one is the second duct.

Thus—and in addition to overcoming, obviating, mitigating and/or traversing one or more problems inherent in the prior art as aforesaid—a number of further benefits (over any previously attempted solutions) may be achieved by the use of the present invention.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the chimney lining system according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
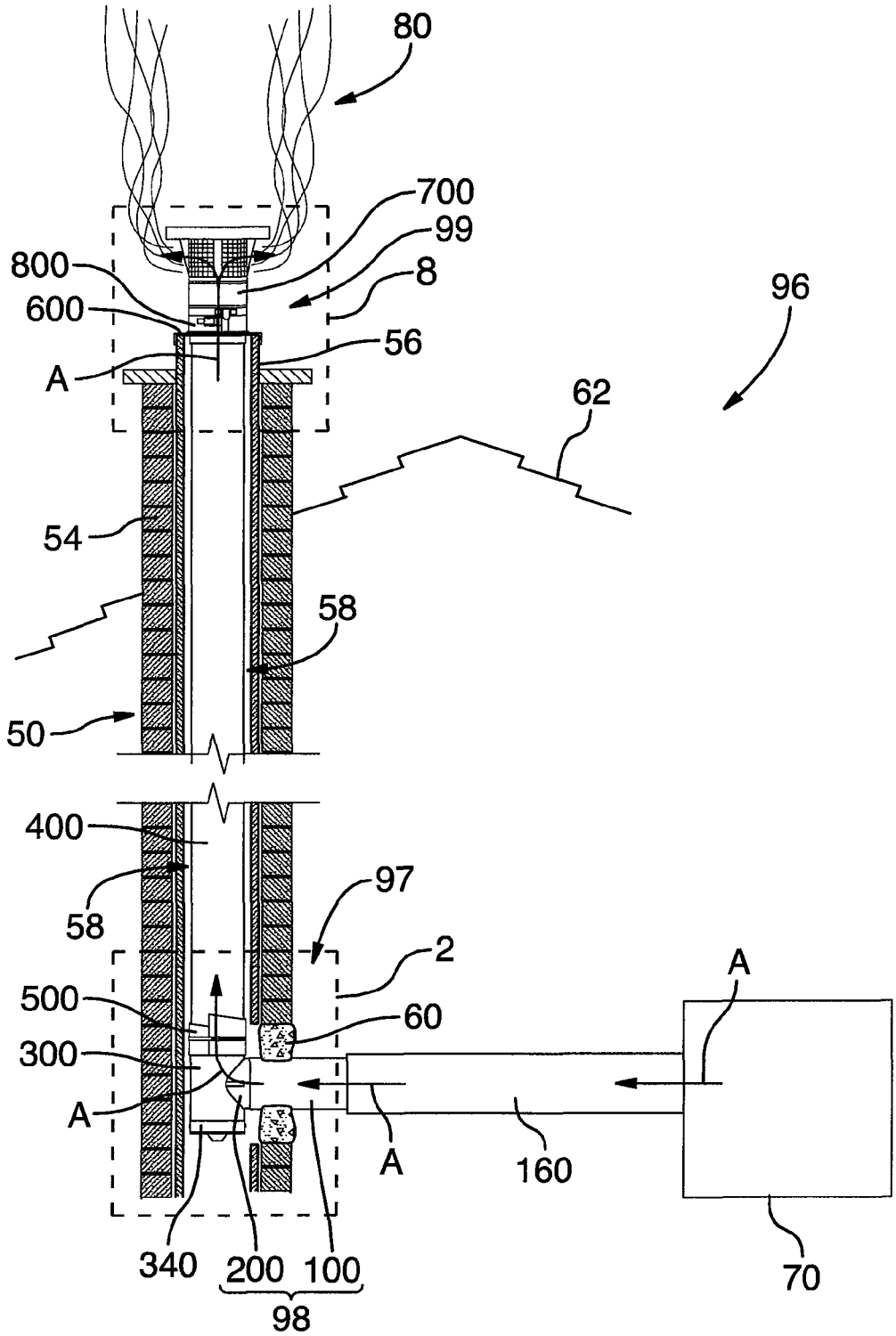
FIG. 1 is left side view of an apparatus according to the present invention, partly in section and in use with a chimney, a roof and an appliance.

Referring now to FIG. 1, there is generally shown a chimney lining apparatus 96 for use with a chimney 50 and an appliance 70.

The chimney 50 includes a plurality of bricks 54 joined together by mortar. Of course, the chimney 50 can be constructed from other materials, as will be appreciated by persons having ordinary skill in the art. Substantially adjacent to the bricks 54 are a plurality of tiles 56—which are, preferably, highly resistant to heat and/or flames—that collectively define an internal chamber 58 of the chimney 50.

Emissions 80 are vented from the appliance 70 along an emission flow path (as generally indicated in the figures by the arrow "A"), through the chimney lining apparatus 96. The chimney lining apparatus 96 includes a bottom assembly 97, a flexible liner 400, and a top assembly 99.

The bottom assembly 97 includes a venting subassembly 98, a base tee member 300, a cleanout cap 340, and a liner base locking device 500. As shown in FIG. 1, the flexible liner 400 and the base tee member 300 are preferably provided within the internal chamber 58 of the chimney 50.

The venting subassembly 98 (alternately, the "venting assembly 98", or the "venting apparatus 98") preferably includes a first duct 100 and a second duct 200. The first duct 100 may be alternately referred to, according to the preferred embodiment shown in the figures, as the "projecting first one 100". The second duct 200 may be alternately referred to, according to the preferred embodiment shown in the figures, as the "socket respective other one 200", the "first locking one 200", or the "first base branch 200".

As shown in FIG. 1, the venting subassembly 98 may, in some embodiments, preferably also include one or more extension ducts 160 in fluid communication with, and interposed between, the appliance 70 and the first duct 100. The number of such extension ducts 160 employed may depend on, among other things, the distance between the appliance 70 and the chimney 50, and other factors relating to the environment in which the apparatus 96 is installed (e.g., the presence of any structures interposed between the appliance 70 and the chimney 50 may necessitate the use of multiple extension ducts 160).

The first duct 100 is in fluid communication with the appliance 70 to vent the emissions 80 from the appliance 70 along the emission flow path "A". The first duct 100 defines an outlet axis B-B, as best seen in FIG. 4A, and has an interior surface 106 and an exterior surface 108.

Figure 5:
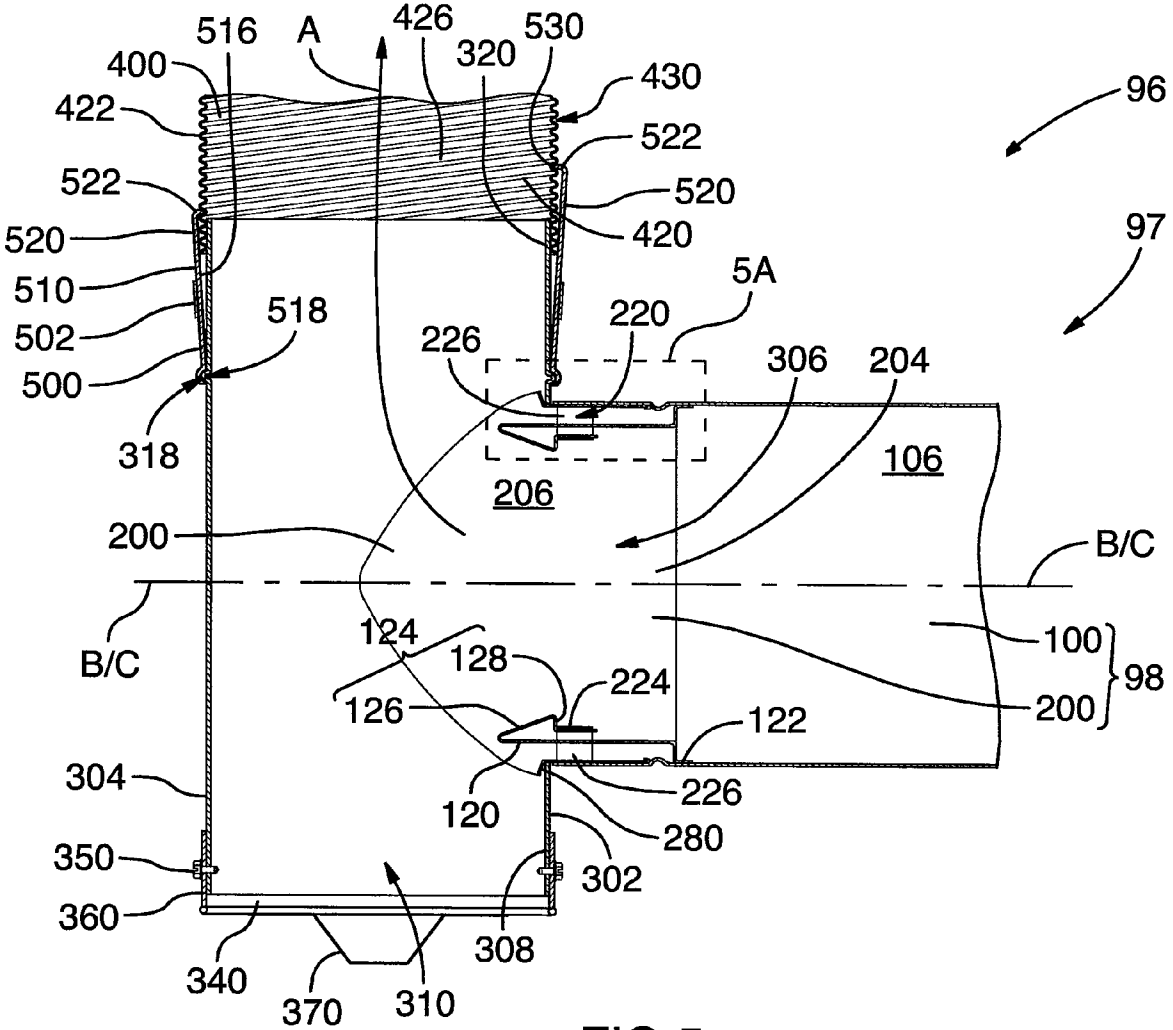
FIG. 5 is an enlarged sectional view along line 5-5 of FIG. 2.
Figure 5A:
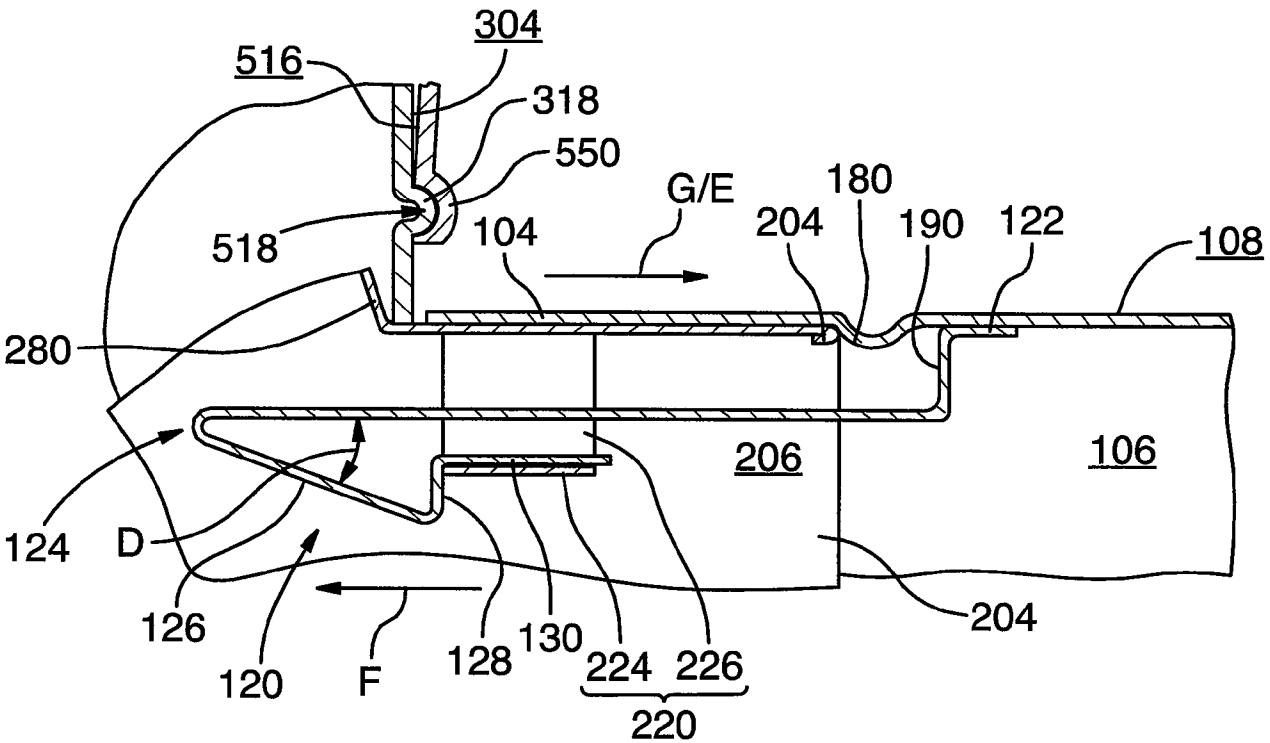
FIG. 5A is an enlarged view of the encircled area 5A of FIG. 5.
Figure 5B:
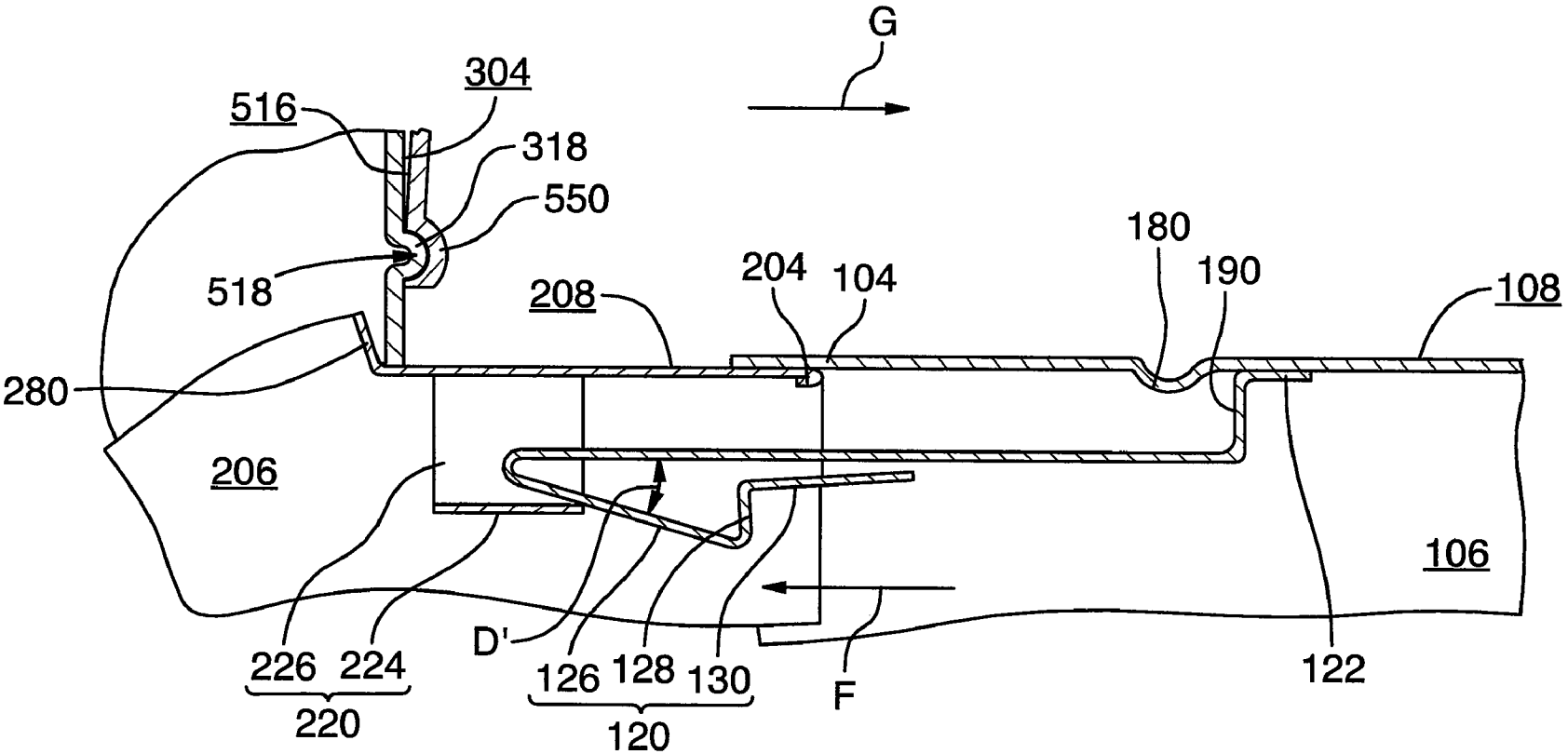
FIG. 5B is a view similar to FIG. 5A, with the anchor member and the socket member therefrom shown in their slidably engaging configuration, with the anchor member in its deflected configuration.

Two projecting members 120 are provided—each one having a projection base 122 that, in the preferred embodiment, and as best shown in FIGS. 5A and 5B, securely engages the first duct 100. Preferably, each projection base 122 securely engages a downstream end portion 104 of the first duct 100. As shown in FIGS. 5 and 5A, each projecting member 120 is preferably formed as an anchor member 120 (and as such, according to the preferred embodiment shown in the figures, the two terms may hereinafter be used interchangeably).

Each projecting member 120 preferably includes a movable portion 124 that extends from substantially adjacent to its projection base 122. The movable portion 124 is provided with a bearing surface 126 and a locking surface 128 substantially adjacent to the bearing surface 126.

Figure 4A:
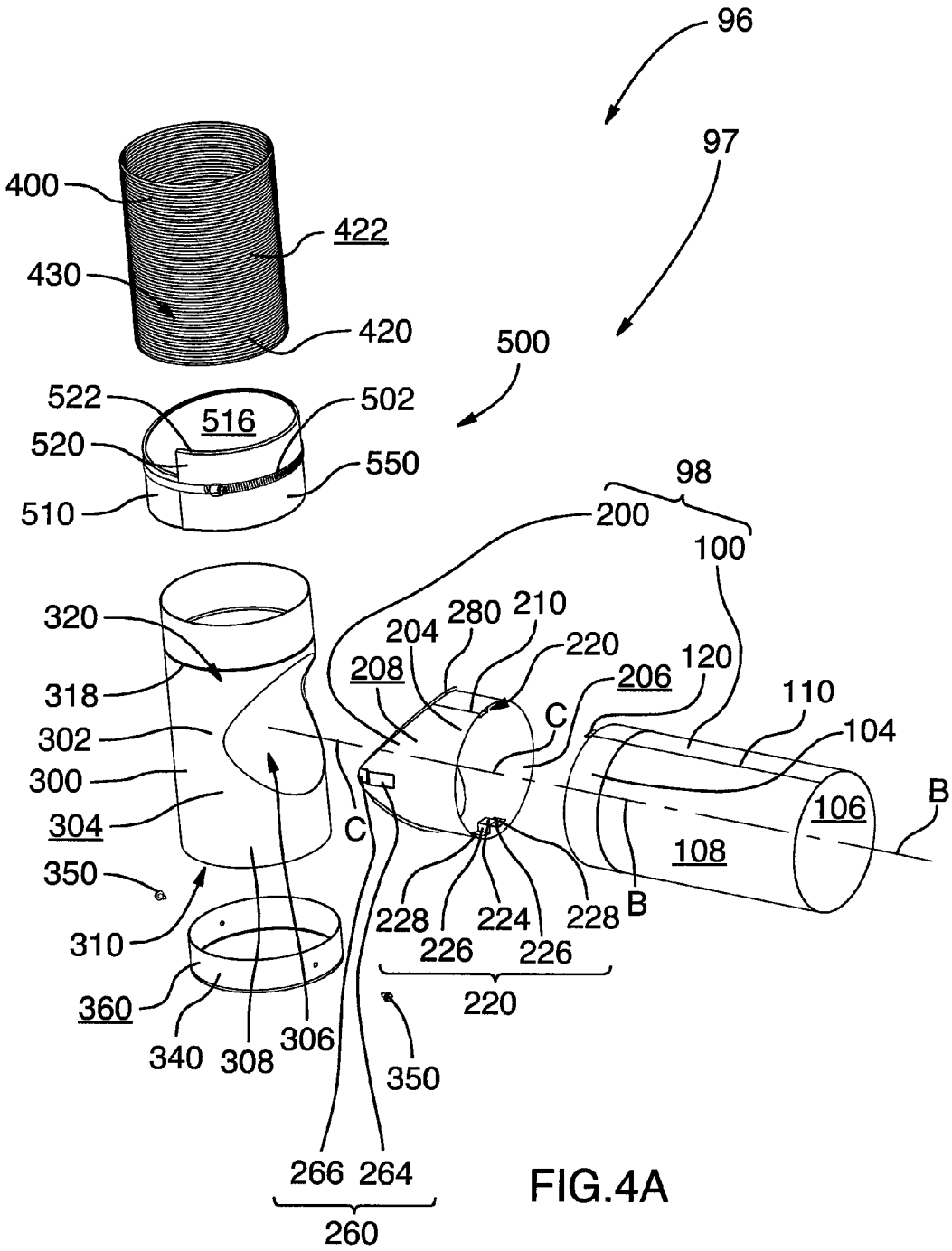
FIG. 4A is a partially exploded view of the bottom assembly of FIG. 3, on a smaller scale.
Figure 4B:
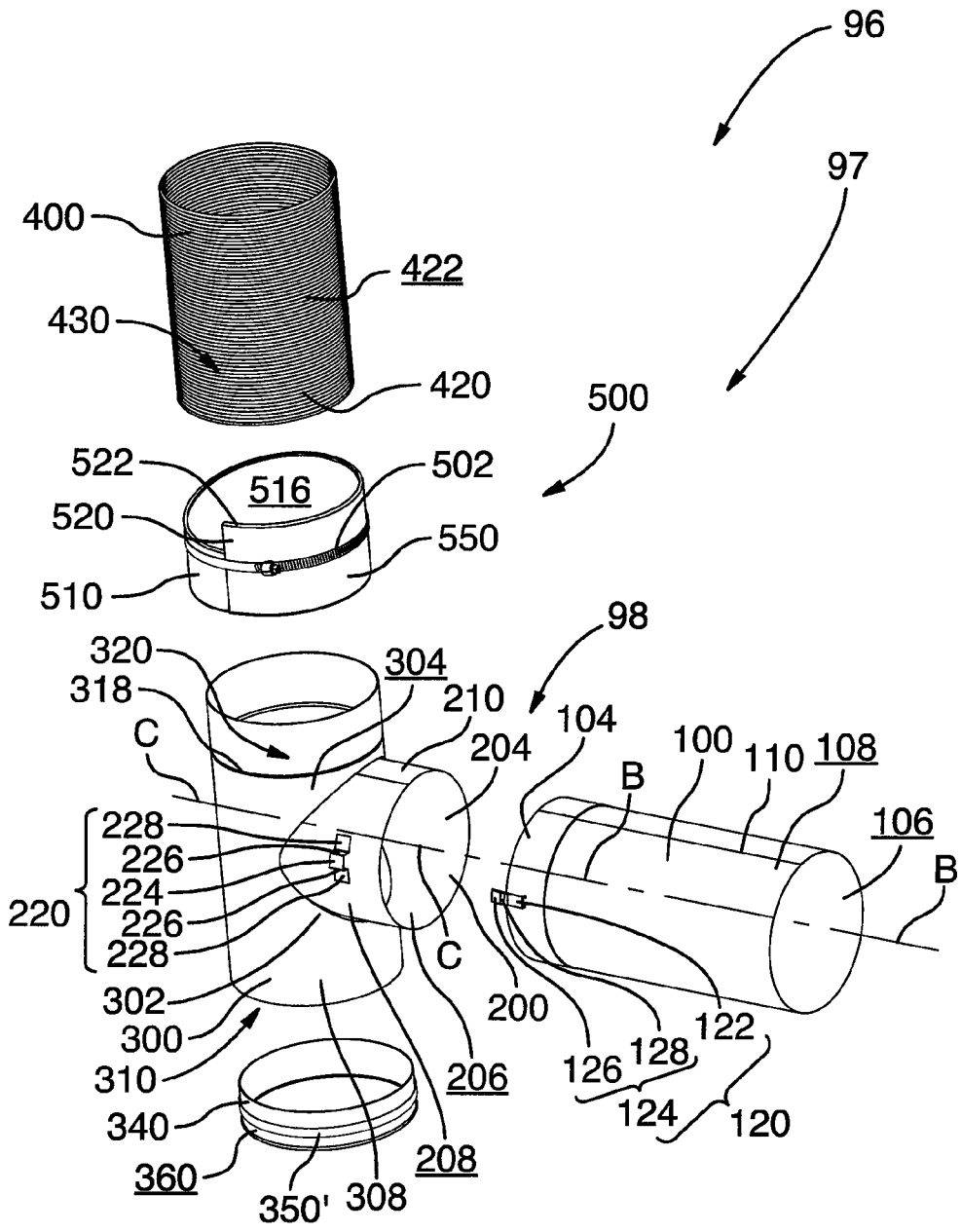
FIG. 4B is a view similar to FIG. 4A of an alternate embodiment of the bottom assembly, with the second duct substantially affixed to the base tee member.

In the embodiment of the invention that is shown in FIG. 4A, the projection base 122 securely engages the interior surface 106 of the first duct 100. Conversely, and as in the embodiment of the invention that is shown in FIG. 4B, the projection base 122 securely engages the exterior surface 108 of the first duct 100.

The second duct 200 is positioned in fluid communication with, and in substantially direct downstream relation along the emission flow path "A" from, the first duct 100. The second duct 200 defines an inlet axis C-C, as best seen in FIG. 4A, and has an 206 and an exterior surface 208.

Two socket members 220 are provided. Each socket member 220 has a socket base 228,228 that, in the preferred embodiment and as best seen in FIGS. 4A to 5B, securely engages the second duct 200. Preferably, each socket base 228 securely engages an upstream end portion 204 of the second duct 200. As best seen in FIGS. 4A and 4B, each socket member 220 is preferably formed as a hat bracket 220 (and as such, according to the preferred embodiment shown in the figures, the two terms may hereinafter be used interchangeably). Preferably, and as best seen in FIGS. 4A and 4B, each hat bracket 220 includes a hat back wall 224 and two hat side walls 226,226 extending from the hat back wall 224. The hat back wall 224 and the two hat side walls 226,226 are together shaped to define a substantially U-shaped hat bracket profile (as best seen in FIGS. 4A and 4B). The two hat side walls 226,226 of each hat bracket 220 together form the socket base 228,228.

In the embodiment of the invention that is shown in FIG. 4A, the socket base 228 securely engages the interior surface 206 of the second duct 200. Conversely, and as in the embodiment of the invention that is shown in FIG. 4B, the socket base 228 securely engages the exterior surface 208 of the second duct 200.

As described in considerably greater detail elsewhere herein, and as best seen in FIG. 5A, the downstream end portion 104 (alternately, the "mating portion 104") of the first duct 100 may securely engage the upstream end portion 204 (alternately, the "mating portion 204") of the second duct 200.

As shown in FIGS. 5 and 5A, each anchor member 120 may preferably extend at least partially through, and into secure engagement with, one of the hat brackets 220, 220. As best seen in FIG. 5A, the anchor member 122 extends between the hat side walls 226 into secure engagement with the hat top wall 224.

Each of the projecting members 120 and socket members 220 has a default configuration, as seen in, for example, FIGS. 5 and 5A. In the preferred embodiment, and as best shown in FIG. 5B, each one of the projecting members 120 is operatively designed for movement from its default configuration towards a deflected configuration (best seen in FIG. 5B), and biased for return therefrom towards its default configuration (best seen in FIG. 5A).

As will be appreciation by a comparison of FIGS. 5A and 5B, each movable portion 124 is movable relative to its projection base 122 between the default configuration and the deflected configuration. The movable portion 124 is resiliently deformable from the default configuration towards the deflected configuration, and biased for resilient return therefrom towards its default configuration. In the default configuration, the movable portion 124 defines a default projecting angle D relative to the projection base 122. In the deflected configuration, the movable portion 124 defines a deflected projecting angle D' relative to the projection base 122. According to the preferred embodiment, and as may be appreciated from a comparison of FIGS. 5A and 5B, the default projecting angle D has a greater magnitude than the deflected projecting angle D'.

The first duct 100 and the second duct 200 are together movable between a slidably engaging configuration, seen in FIG. 5B, and a locked configuration, seen in FIG. 5A.

Preferably, in the slidably engaging configuration, the projecting members 120 bear against the socket members 220, such that the projecting members 120 are preferably removed from their default configuration towards the deflected configuration. More specifically, in the slidably engaging configuration and as best seen in FIG. 5B, the bearing surface 126 slidably engages the socket member 220, such that the movable portion 124 is operatively removed from the default configuration towards the deflected configuration.

In the locked configuration, the first projecting member 120 and the first socket member 220 are each in the default configuration, with the first projecting member 120 securely and matingly engaging the first socket member 220. More specifically, in the locked configuration and as best seen in FIGS. 5 and 5A, the movable portion 124 is in the default configuration, with the locking surface 128 securely and matingly engaging the socket member 220. As such, movement of the socket members 220 relative to the projecting members 120 is substantially restrained in at least a first restraining direction "F" substantially parallel to the emission flow path "A".

As best seen in FIGS. 5 and 5A, the apparatus 96 also preferably includes at least one stop member 180 (alternately referred to, in accordance with the preferred embodiment shown in the figures as a "first duct bead member 180"), provided on the first duct 200. Preferably, the first duct bead member 180 engages the upstream end portion 204 of the second duct 200. (Of course, the upstream end portion 204 may alternately be viewed as the stop member, with the upstream end portion 204 engaging the first duct bead member 180). As such, in the locked configuration and as best seen in FIG. 5A, the stop member operatively restrains movement of each socket member 220 relative to each projecting member 120 in at least a second restraining direction "G" that is substantially opposed to the first restraining direction "F". Preferably, and as best seen in FIG. 5A, the projecting members 120 may also be formed to define a secondary stop member 190, which may serve as a back-up stop in the event that the upstream end portion 204 of the second duct 200 is deformed to pass over the first duct bead member 180.

As such, the second duct 200 operatively and securely engages the first duct 100, with the outlet axis B-B being substantially co-axial with the inlet axis C-C and operatively oriented substantially along the emission flow path "A", to vent the emissions 80 from the appliance 70 downstream of the venting assembly 98.

Figure 2:
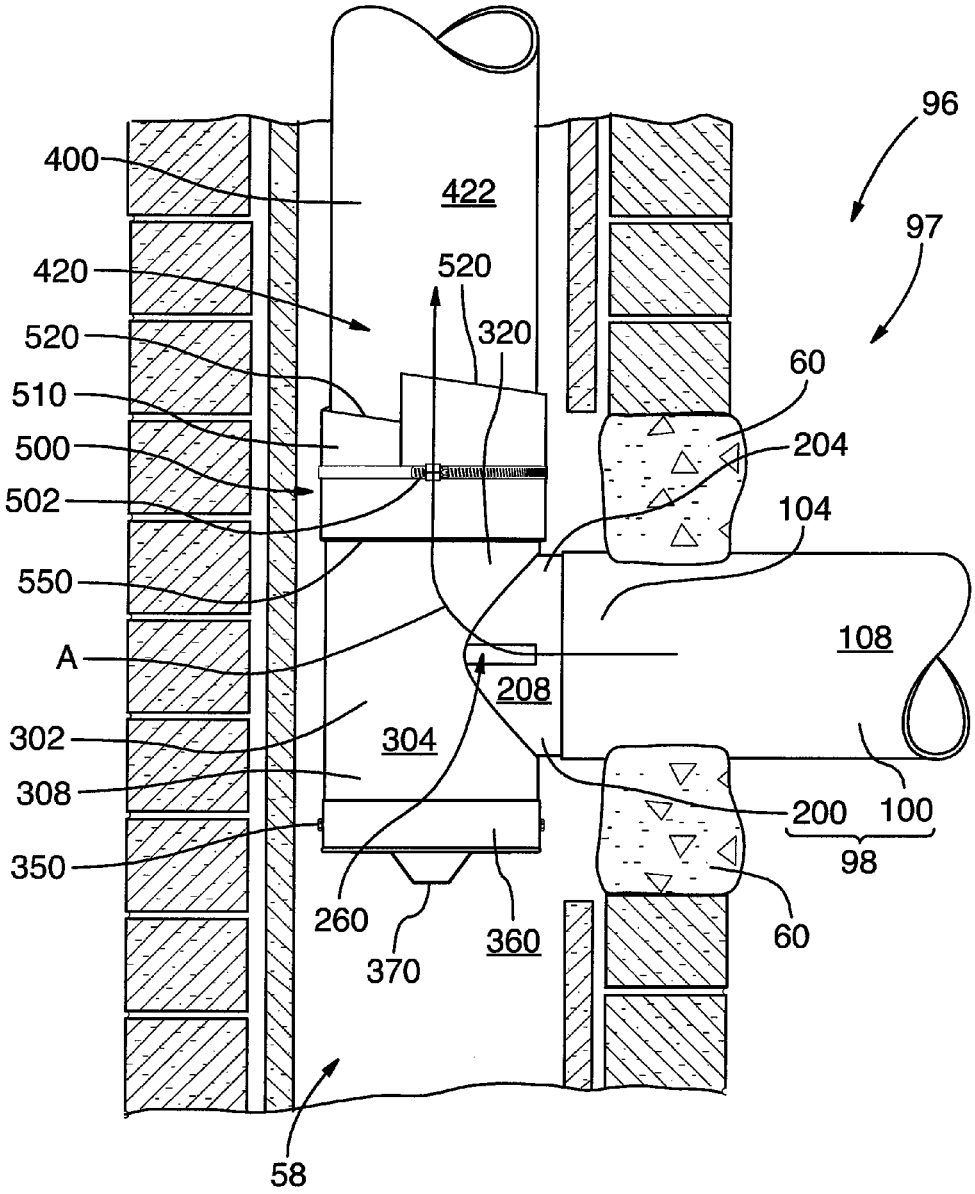
FIG. 2 is an enlarged view of the enclosed area 2 of FIG. 1.

The base tee member 300 (alternately, the "respective other base branch 300") is operatively positioned within the chimney 50, as best shown in FIG. 2, and has a base sidewall portion 302 (alternately, the "respective other locking one 302") with an exterior surface 304, and with a base side aperture 306 being defined therethrough, as best shown in FIG. 4A. The base tee member 300 also has a base bottom end portion 308 (alternately, the "securing respective other one 308") and a base top end portion 320 (alternately, the "sealing respective other one 320") as shown in, for example, FIG. 4A.

Operatively, the second duct 200 securely engages and operatively extends from the base sidewall portion 302. Accordingly, and as will be appreciated from a consideration of, for example, FIGS. 2 and 3, the base side aperture 306 of the base tee member 300 is in fluid communication and in substantially direct downstream relation along the emission flow path "A" from the second duct 200. As such, the emissions 80 from the venting assembly 98 are operatively vented, downstream along the emission flow path "A", from the second duct 200, through the base side aperture 306, and into the base tee member 300.

Figure 6:
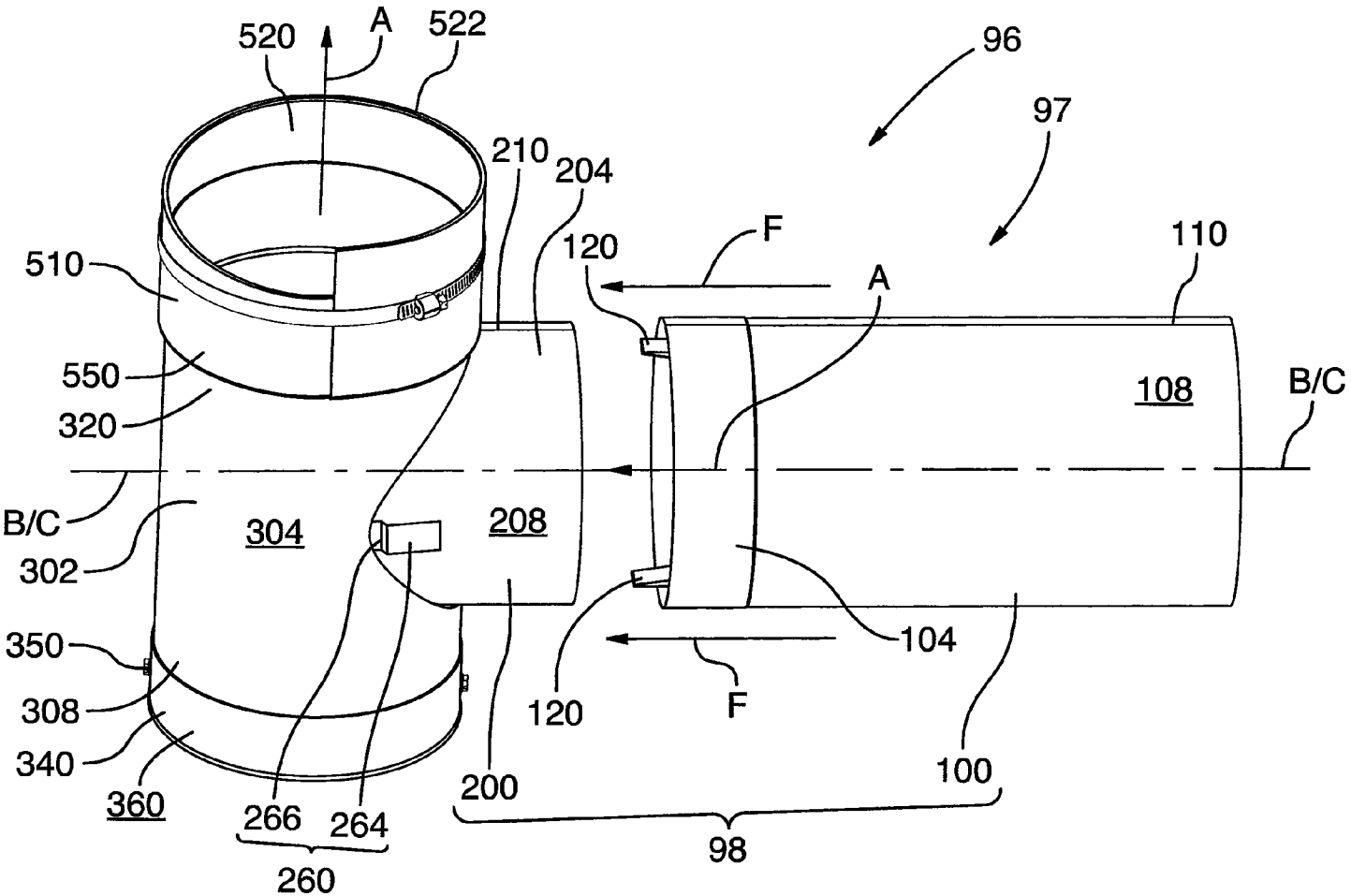
FIG. 6 is a left side elevational view of the bottom assembly, with the first duct shown exploded therefrom.
Figure 7:
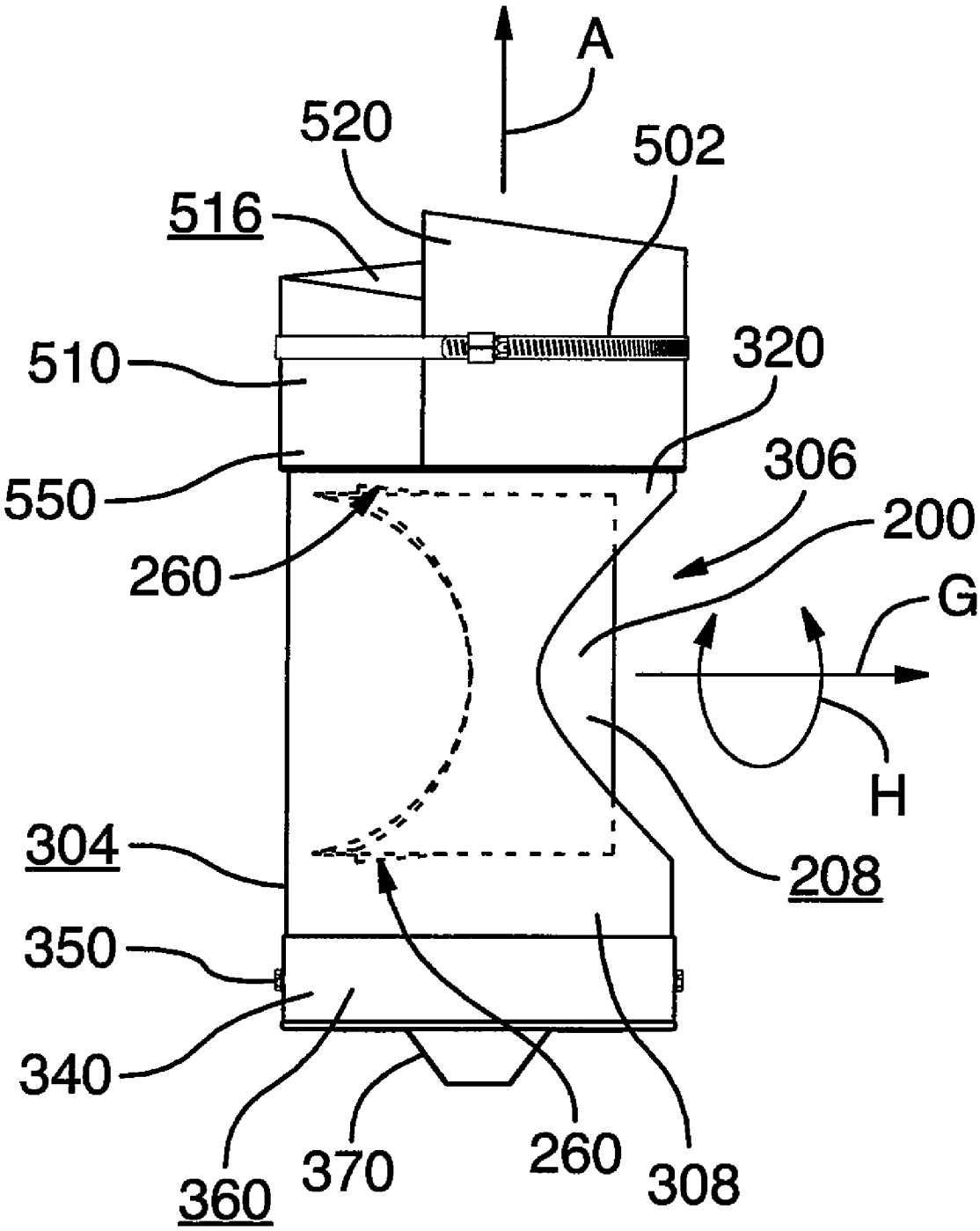
FIG. 7 is a left side partially sectional view of the base tee, showing the tee branch nested therewithin.

In some embodiments according to the invention (particularly where the base tee members 300 are of relatively large diameters, e.g., more than about four inches in diameter), it is advantageous for the second duct 200 and the base tee member 300 to be together adapted for movement between a proving configuration, as shown in FIG. 7, and the operative configuration discussed in the preceding paragraph and shown in, for example, FIGS. 2, 3, 4B and 6.

In such embodiments, a base branch locking device 260 is also provided on, and securely affixed to, the second duct 200, as best seen in FIG. 4A. The base branch locking device 260 includes two resilient locking tab members 260, 260. Each of the tab members 260, 260 is resiliently deformable from a default tab configuration, shown in FIG. 4A, towards a deflected tab configuration, and biased for resilient return therefrom towards the default tab configuration. Each of the tab members 260, 260 is provided with a bearing tab surface 264 and a locking tab surface 266 substantially adjacent to the bearing tab surface 264, as best seen in FIGS. 4A and 6.

Figure 3:
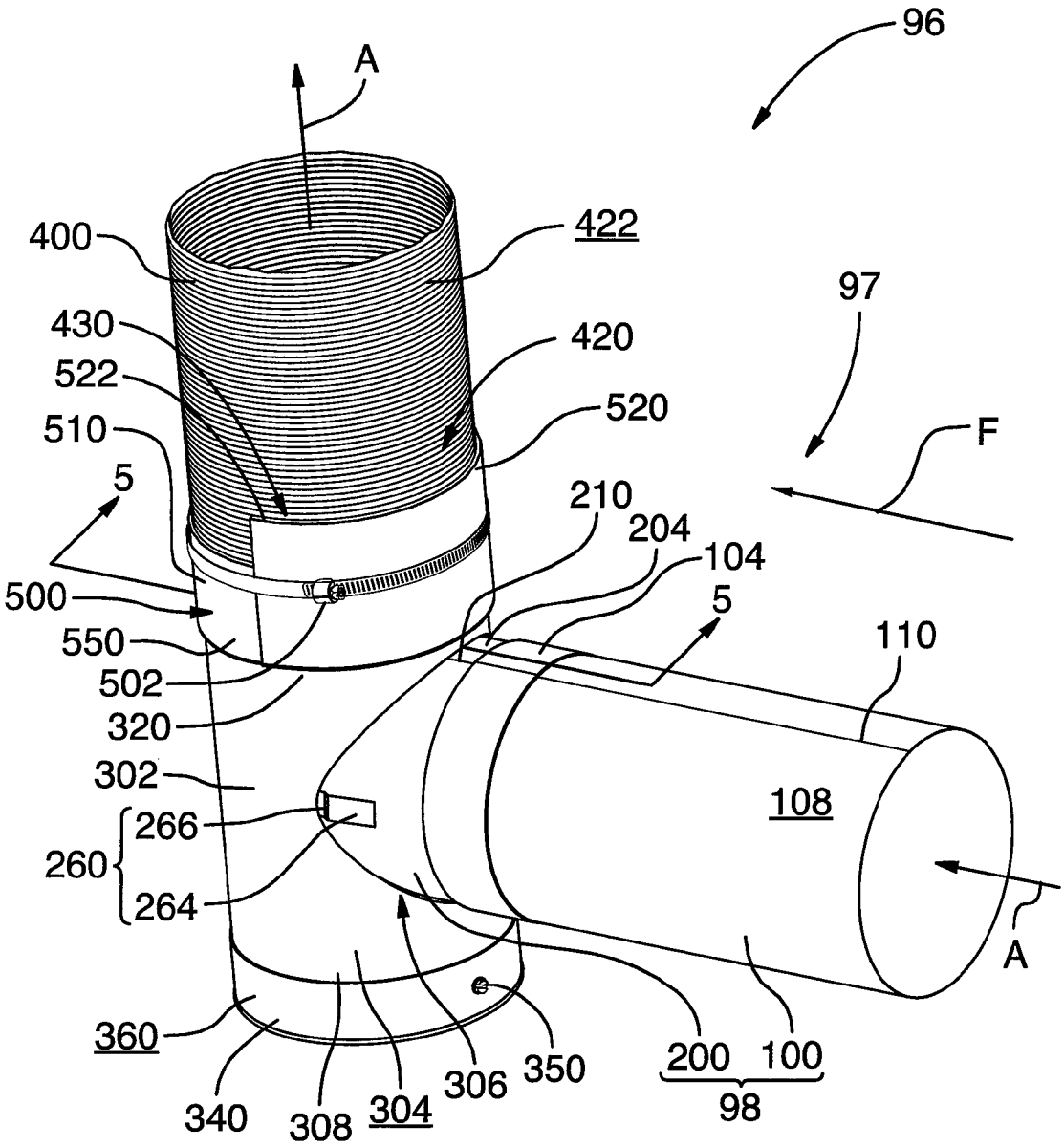
FIG. 3 is left side perspective view from above of a bottom assembly.

In the operative configuration, the locking tab members 260, 260 are in their default tab configurations, and the locking tab surfaces 266 securely and matingly engage the base sidewall portion 302 substantially adjacent to the base side aperture 306, as shown in FIG. 3. As such, movement of the second duct 200 relative to the base sidewall portion 302 is substantially restrained at least in a generally downstream direction "F" (indicated by the like labeled arrow in FIG. 3, and alternately referred to as the "first branch direction "F"") substantially parallel to the emission flow path "A".

A stop branch member 280 is also provided on the second duct 200, as best seen in FIG. 4A, which securely engages the base tee member 300 in the operative configuration, such as to substantially restrain movement of the second duct 200 relative to the base sidewall portion 302 in at least a second branch direction "G" (shown in FIG. 7) substantially opposed to the first branch direction "F" (shown in FIG. 3).

From the foregoing, it should be appreciated that, in the operative configuration, the base branch locking device 260 (provided on the second duct 200) securely engages the base sidewall portion 302, so that the second duct 200 is effectively secured thereto.

Now, in the proving configuration, best seen in FIG. 7, the second duct 200 is nested within the base tee member 300. During movement between the proving configuration and the operative configuration, the bearing tab surface 264 of each of the tab members 260, 260 slidably engages the base sidewall portion 302 at loci substantially adjacent to the base side aperture 306. Accordingly, the resiliently deformable locking tab members 260, 260 are removed from their default tab configurations towards their deflected tab configurations.

In other embodiments according to the invention (particularly where the base tee members 300 are of relatively small diameters, e.g., three or four inches in diameter), and as best seen in FIG. 4B, the second duct 200 may be securely and substantially permanently affixed to the base tee member 300.

The base bottom end portion 308 defines a base bottom aperture 310 therethrough. The cleanout cap 340 (alternately, hereinafter referred to as the "securing first one 340") operatively occludes the base bottom aperture 310, as will be appreciated from a comparison of FIGS. 3 (aperture 310 occluded) and 4A (aperture 310 un-occluded). A cap locking fastener 350—in the form of either a releasable joiner band 35*a* (see FIG. 4B) or a plurality of more conventional mechanical fasteners 350 (see, for example, FIG. 4A)—is provided to operatively secure the cleanout cap 340 to the base bottom end portion 308. In some embodiments of the invention (not shown) the releasable joiner band 350' may be operatively positioned about an exterior cap surface 360 of the cleanout cap 340, so as to compress the cleanout cap 340, into readily releasable relation, against the base bottom end portion 308. A cap handle 370 is also preferably provided and extends from the cleanout cap 340, as seen in FIGS. 2 and 5, to help facilitate ready removal of the cleanout cap 340 from the base bottom end portion 308.

The base tee member 300 is shaped to define a first bead 318 substantially circumscribing the base top end portion 320, as best seen in section in FIGS. 5A and 5B, and extending in a substantially outward direction "E" (which points outwardly from the base tee member 300, and, thus, is pointed on opposite directions on opposite sides thereof), from the exterior surface 304 of the base tee member 300.

Figure 10:
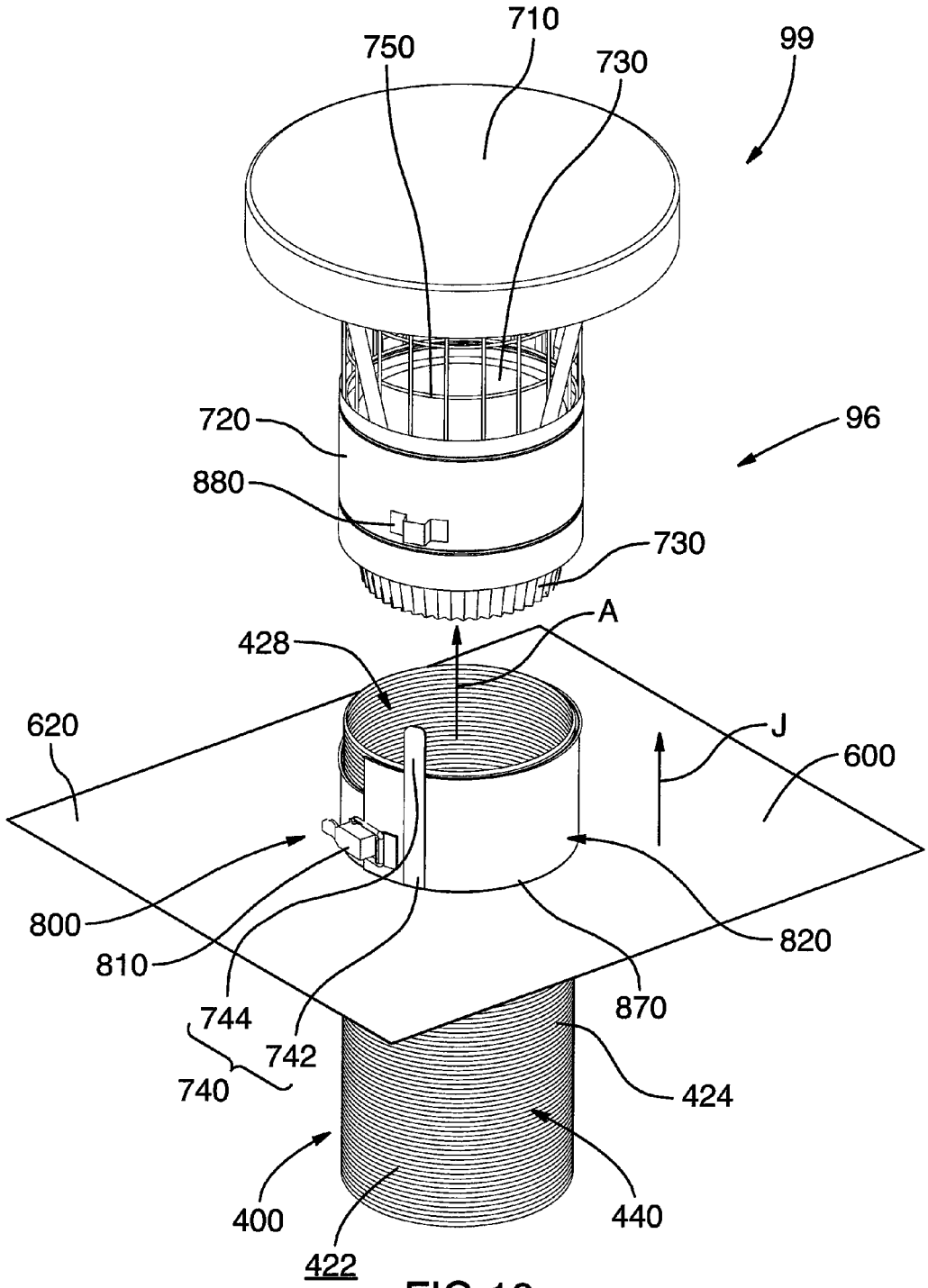
FIG. 10 is a top front side perspective view of the top assembly, shown with the vent cap in a partially exploded configuration.

The flexible liner 400 has an exterior surface 422, a liner bottom end portion 420 (alternately, the "sealing first one 420"), and a liner top end portion 424 that is shaped to define a top emission outlet 428, as best seen in FIG. 10.

Preferably, and as shown in FIGS. 4A and 4B, the flexible liner 400 is shaped, substantially adjacent to the liner bottom end portion 420, to define a plurality of helical grooves 430 extending about its exterior surface 422 (with at least one of the helical grooves 430 being, hereinafter, alternately referred to as the "helical first one 430").

Preferably, and as shown in FIG. 10, the flexible liner 400 is also shaped, substantially adjacent to the liner top end portion 424, to define a plurality of helical top grooves 440 extending about its exterior surface 422 (with at least one of the helical grooves 440 being, hereinafter, alternately referred to as the "first helical top one 440"). One or more of the helical top grooves 440 may preferably extend helically substantially along the entire length of the flexible liner 400, such as to be contiguous with one or more of the helical grooves 430 adjacent the liner bottom end portion 420.

The flexible liner 400 is operatively positioned within the chimney 50, with the liner bottom end portion 420 about the exterior surface 422 of the base tee member 300. As such, the flexible liner 400 operatively engages, and is in fluid communication with the base tee member 300 (and directly downstream along the emission flow path "A" therefrom), as best seen in section in FIG. 5.

The liner base locking device 500 includes a locking clamp 502 and a base lock body 510 having an interior surface 516, a base lock upper edge portion 520, and a base lock lower edge portion 550, as best seen in section in FIGS. 5A and 5B. A second bead 518 is formed as a depression 518 in the interior surface 516 of the liner base locking device 500, and substantially circumscribes the base lock lower edge portion 550.

Operatively, and as best seen in section in FIG. 5, the locking clamp 502 is positioned over the base lock body 510 which is, in turn, situated about the exterior surface 422 of the flexible liner 400 substantially adjacent to the liner bottom end portion 420. The base lock lower edge portion 550, however, is substantially adjacent to the exterior surface 304 of the base tee member 300, as best seen in FIGS. 5A and 5B.

As best seen in FIGS. 3, 4A and 4B, the locking clamp 502 is preferably a screw clamp 502 (and, as such, these two terms may hereinafter be used interchangeably). Of course, other types of locking clamps 502 may also be used in place of the screw clamp 502 shown in, inter alia, FIGS. 3, 4A and 4B. In the preferred embodiment, and as will be appreciated from a consideration of FIGS. 2 and 5, the locking clamp 502 operatively compresses the liner bottom end portion 420, into substantially sealed relation, against the base top end portion 320.

The base lock upper edge portion 520 is provided with an upper base lip member 522 that is, preferably, shaped to define a helical ridge 530 (alternately, the "helical respective other one 530"), as shown in section in FIG. 5. Operatively, the helical ridge 530 matingly engages, and is secured to, one of the helical grooves 430 in the exterior surface 422 of the flexible liner 400, such that the upper base lip member 522 is secured to the liner bottom end portion 420 in substantially sealed relation.

The second bead 518 (on the base lock lower edge portion 550) matingly engages, and is operatively secured to the first bead 318 (on the base tee member 300), in substantially sealed relation, such that the base lock lower edge portion 550 is secured to the base top end portion 320 in substantially sealed relation, as shown in FIGS. 2 and 5.

In the aforesaid manner, the liner base locking device 500 operatively secures the base top end portion 320 to the liner bottom end portion 420 in substantially sealed relation. Accordingly, the emissions 80 from the venting assembly 98 are operatively vented, downstream along the emission flow path "A", through the base tee member 300 and into the flexible liner 400.

The top assembly 99 includes a flashing member 600, a vent cap 700 (alternately, the "first cap locking one 700"), and a liner top locking device 800 (alternately, the "respective other cap locking one 800").

Figure 11:
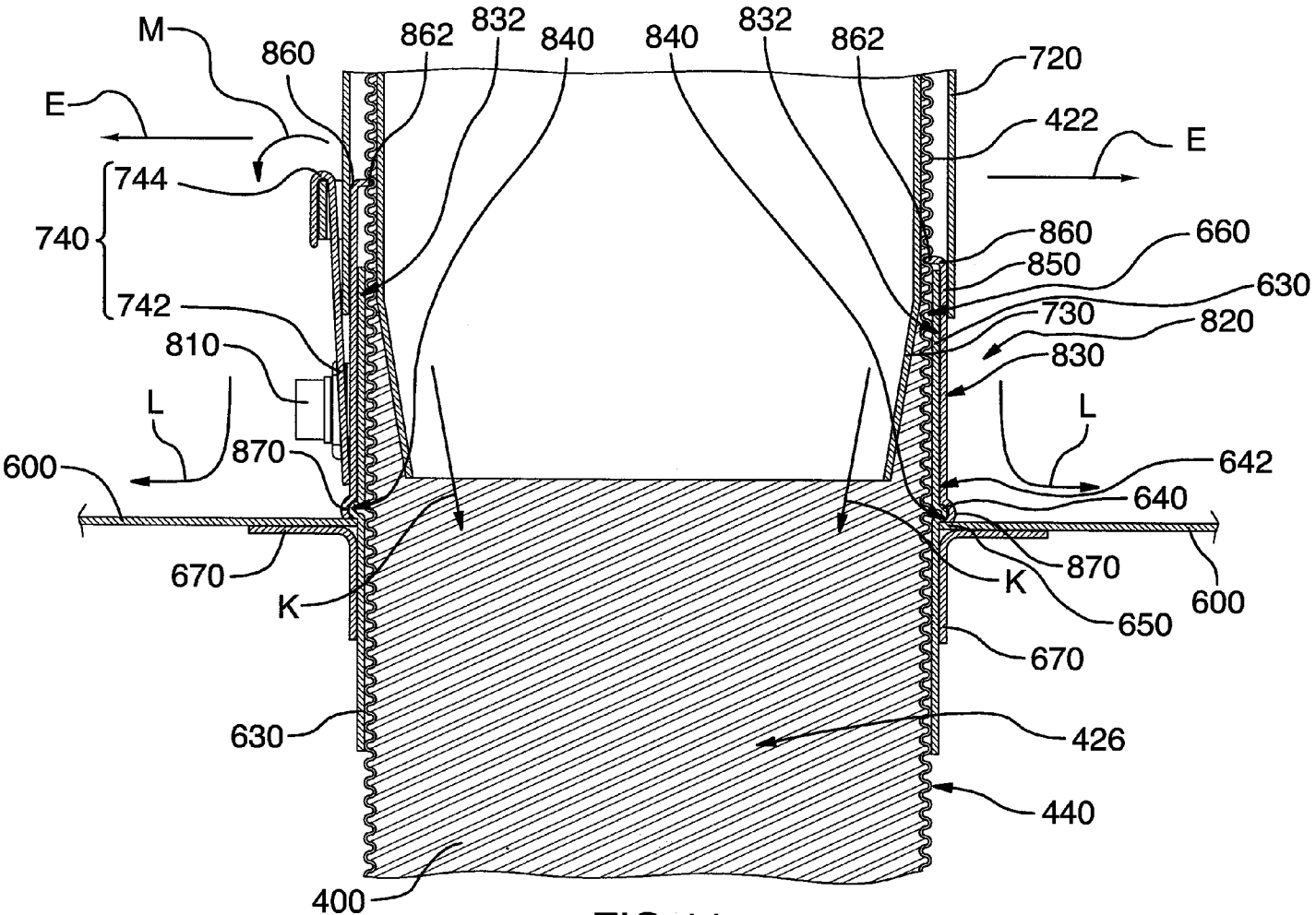
FIG. 11 is an enlarged sectional view along line 11-11 of FIG. 9.

The flashing member 600 is securely engagable with the chimney 50 and has a flashing top portion 620 and an inside flashing edge 650 shaped to define a flashing aperture 660 through the flashing member 600, as shown in FIG. 11. The flashing top portion 620 includes a secure flashing collar 630 substantially adjacent to the inside flashing edge 650, as seen in FIG. 11. The secure flashing collar 630 is shaped to define a first top bead 640 at least partially circumscribing the inside flashing edge 650, with the first top bead 640 being formed as a top projection 640 extending in the substantially outward direction "E" from the secure flashing collar 630, as best seen in section in FIG. 11.

The liner top end portion 424 operatively extends through the flashing aperture 660, such that the flashing member 600 is operatively positioned in generally downstream relation from the base tee member 300, as shown in FIG. 1.

The vent cap 700 has an upper shield 710, an outer cap surface 720, and an inner skirt 730, as best seen in FIG. 10. A projecting cap locking member 740 is, preferably, also provided on the vent cap 700 in the form of a bendable anchor tab 740, as shown in FIGS. 8 through 11. The inner skirt 730 operatively engages, and extends to inside of, the liner top end portion 424, as best seen in section in FIG. 11. The vent cap 700 is in fluid communication with, and in substantially direct downstream relation along the emission flow path "A" from, the flexible liner 400.

The liner top locking device 800 (alternately, the "other cap locking one 800") includes a locking top clamp 810 and a top lock body 820 having an exterior top locking surface 830, an interior top locking surface 832, a top lock upper edge portion 850, and a top lock lower edge portion 870, as shown in FIG. 11. A socket cap locking member 880 is, preferably, also provided on the liner top locking device 800 in the form of a hat cap locking bracket 880, as best seen in FIG. 10.

Figure 8:
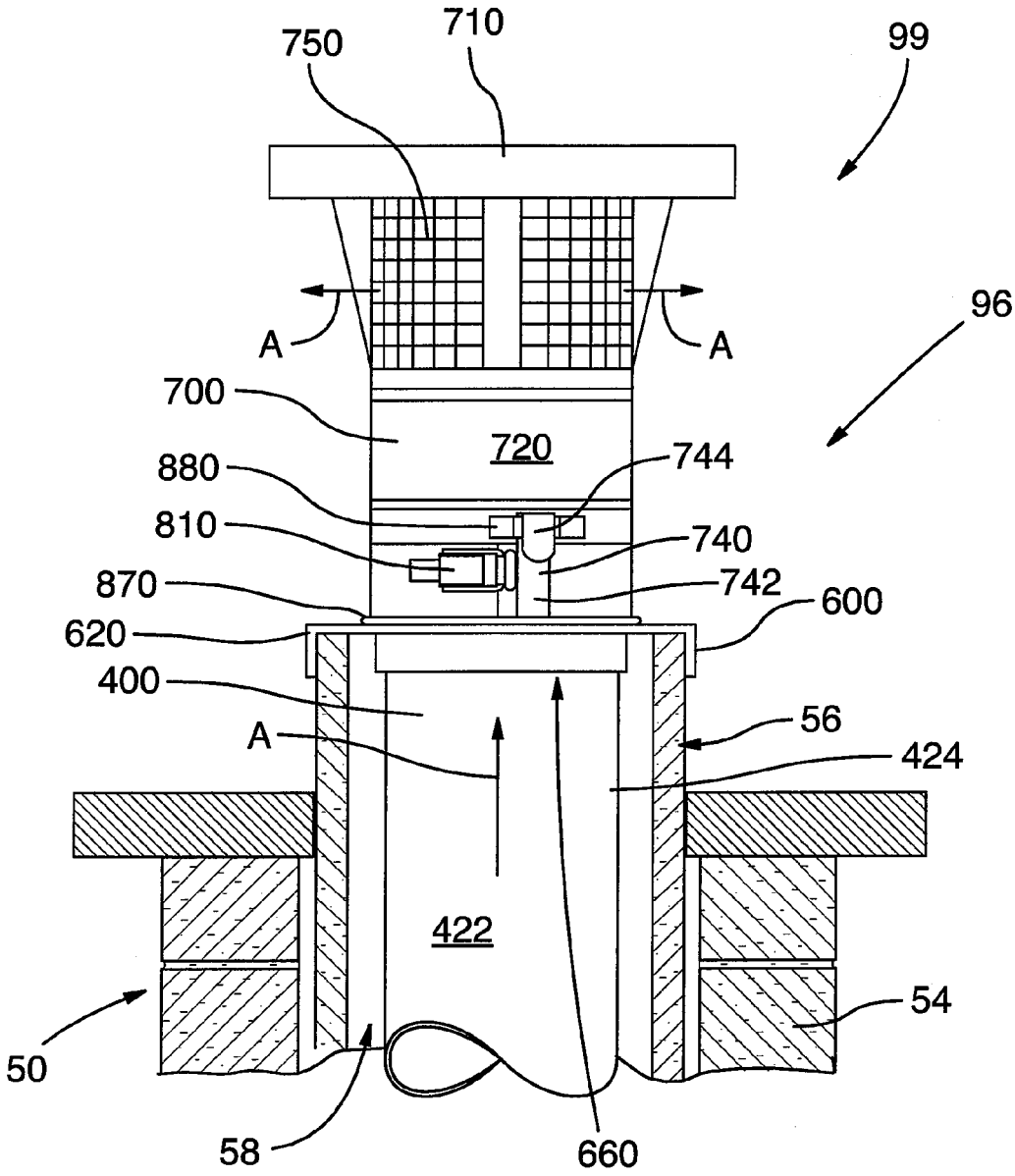
FIG. 8 is an enlarged view of the enclosed area 8 of FIG. 1.
Figure 9:
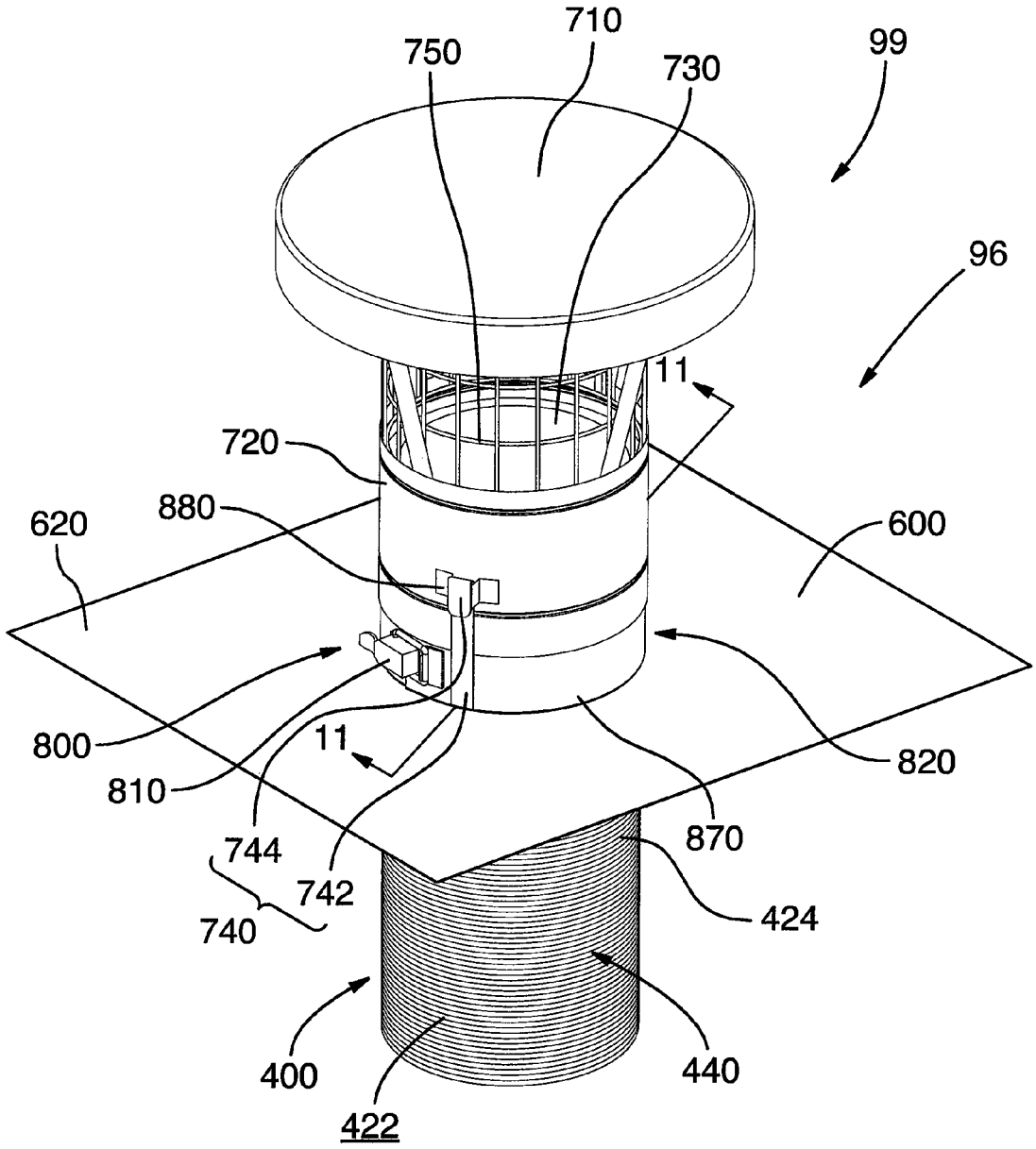
FIG. 9 is a top front side perspective view of the top assembly.

Operatively, in the preferred embodiment, and as best shown in FIGS. 8 through 10, the locking top clamp 810 is provided on the exterior surface 830 of the top lock body 820 which is, in turn, situated about both the secure flashing collar 630 and the exterior surface 422 of the flexible liner 400 substantially adjacent to the liner top end portion 424, as best shown in section in FIG. 11.

The top lock upper edge portion 850 is substantially adjacent to the exterior surface 422 of the flexible liner 400. The top lock upper edge portion 850 is provided with an upper top lip member 860 that is, preferably, shaped to define a helical top ridge 862 (alternately, the "respective other helical top one"), as best seen in section in FIG. 11.

The top lock lower edge portion 870 is substantially adjacent to the exterior surface 642 of the secure flashing collar 630. A second top bead 840 is formed as a depression 840 in the interior top locking surface 832 (of the liner top locking device 800) substantially adjacent to, and at least partially circumscribing, the top lock lower edge portion 870, as seen in FIG. 11.

As best seen in FIGS. 8 through 10, the locking top clamp 810 is preferably a ratchet clamp 810 (and, as such, these two terms may hereinafter be used interchangeably). Of course, other types of locking clamps may also be used in place of the ratchet clamp 810 shown in FIGS. 8 through 10.

Preferably, when the ratchet clamp 810 is closed, the top lock body 820 may compress the secure flashing collar 630 against the liner top end portion 424, as shown in FIG. 11. The top lock lower edge portion 870 operatively engages, and is secured to, the flashing top portion 620. The second top bead 840 (on the liner top locking device 800) matingly engages, and is operatively secured to the first top bead 640 (on the secure flashing collar 630), in substantially sealed relation, and as shown in section in FIG. 11, such that the top lock lower edge portion 870 is secured to the flashing top portion 620 in substantially sealed relation. At the same time, the helical top ridge 862 matingly engages, and is operatively secured to, one of the helical top grooves 440 in the exterior surface 422 of the flexible liner 400, such that the upper top lip member 860 is secured to the liner top end portion 424, as shown in FIG. 11. In this manner, the liner top locking device 800 operatively secures the liner top end portion 424 to the flashing member 600.

The outer cap surface 720 of the vent cap 700 is operatively positioned outside of the liner top locking device 800, as shown in section in FIG. 11. The projecting cap locking member 740 is operatively secured to the mating socket cap locking member 880, as shown in FIGS. 8 and 9. Preferably, a bendable tab tip portion 744 of the bendable anchor tab 740 extends through and is bent over, so as to securely engage, the hat cap locking bracket, as shown in FIGS. 8 and 9. As such, the vent cap 700 is operatively secured to the liner top locking device 800. Accordingly, the emissions 80 from the flexible liner 400 are operatively vented, downstream along the emission flow path "A", through the vent cap 700, to outside of the chimney lining apparatus 96.

The upper shield 710 partially shields the top emission outlet 428 from environmental precipitation and permits the emissions 80 to be operatively vented, through the vent cap 700, to outside of the chimney 50 and the chimney lining apparatus 96. The flashing top portion 620 is operatively positioned substantially outside, and in substantially sealing relation with, the chimney 50. Accordingly, in operation, any precipitation impinging upon the vent cap 700 is operatively substantially directed either towards an inside 426 of the flexible liner 400 or across the flashing top portion 620 exterior of the chimney 620, as generally indicated by arrows "K" and "L" in FIG. 11, which denote an interior run-off direction and an exterior run-off direction, respectively.

Reference will now be made, briefly, to a method of installing the preferred embodiment, and other embodiments that lie within the scope, of the invention. Of course, the installation of the invention, will enable the method to likewise be viewed as a method of venting the emissions 80 from the appliance 70. It will be appreciated by persons having ordinary skill in the art that each of the steps of the method is best understood, seen, and depicted in any figures which may respectively show the associated structures which are referenced in such steps as being acted upon.

The method preferably includes the following steps:

(a) a first connecting step, (b) a second connecting step, (c) a first pre-assembly step before the second connecting step, (d) a base tee connecting step before the first connecting step, (e) a liner connecting step, (f) a base locking step, (g) a tab pre-assembly step before the base locking step, (h) a flashing insertion step, (i) a liner top locking step, (j) a vent cap securing step, and (k) a projection pre-assembly step before the second connecting step.

Preferably, the second connecting step is performed before the first connecting step. Before the second connecting step, the projection base 122 of each projecting member 120 securely engages the projecting first one 100, and the socket base 228 of the mating socket member 220 220 securely engages the socket respective other one 200, of the first duct 100 and the second duct 200. Before the second connecting step, each one of the projecting members 120 and the socket members 220 is in a respective default configuration.

In the first pre-assembly step, the projecting members 120 are made movable from their aforesaid default configuration towards a deflected configuration, and biased for return therefrom towards its aforesaid default configuration.

In the projection pre-assembly step, the movable portion 124 is made resiliently deformable from the default configuration towards the deflected configuration, and biased for resilient return therefrom towards its said default configuration.

In the second connecting step, the second duct 200 is connected, in said fluid communication, to the first duct 100. As such, the second duct 200 is in substantially direct downstream relation, and is adapted to vent the emissions 80, from the first duct 100 along the emission flow path "A".

In the second connecting step, the first duct 100 and the second duct 200 together move from a slidably engaging configuration towards a locked configuration. In the slidably engaging configuration, the projecting members 120 and the socket members 220 bear against one another. As such, the projecting members 120 are removed from the default configuration towards the deflected configuration.

In the locked configuration, the projecting member 120 and the socket members 220 are each in the default configuration. The projecting members 120 securely and matingly engages the socket members 220. As such, the second duct 200 operatively and securely engages the first duct 100. The outlet axis B-B of the first duct 100 is substantially co-axial with the inlet axis C-C of the second duct 200, and operatively oriented substantially along the emission flow path "A". The emissions 80 from the appliance 70 are vented downstream of the second duct 200.

In the second connecting step, the anchor member 120 extends at least partially through, and into secure engagement with, the hat bracket 220.

In the second connecting step, the movable portion 124 of each projecting member 120 moves, relative to its projection base 122, between the default configuration and the deflected configuration. In the slidably engaging configuration, the bearing surface 126 of the movable portion 124 slidably engages the socket member 220, such that the movable portion 124 is removed from the default configuration towards the deflected configuration. In the locked configuration, the movable portion is in the default configuration. The locking surface 128 of the projecting members 120 securely and matingly engage the socket members 220, so as to restrain movement of the socket members 220 relative to the projecting members 120 in at least the first restraining direction "F".

In the locked configuration of the second connecting step, the stop member 180 on the projecting first one 100 engages the socket respective other one 200, so as to restrain movement of the socket member 220 relative to the projecting member 120 in at least the second restraining direction "G" substantially opposed to the first restraining direction "F".

Preferably, the liner connecting step is performed before the base tee connecting step. In the liner connecting step, the flexible liner 400 is connected, in fluid communication, to the base tee member 300. As such, the flexible liner 400 is in said substantially direct downstream relation, and is adapted to vent the emissions 80, from the base tee member 300 along the emission flow path "A".

Before the base locking step, the resilient locking tab member 260 is securely attached to the second duct 200, with the locking tab member 260 being in the default tab configuration.

In the tab pre-assembly step, the locking tab 260 is made resiliently deformable from the default tab configuration towards the deflected tab configuration, and biased for resilient return therefrom towards the default tab configuration.

In the base locking step, the base top end portion 320 of the base tee member 300 is secured to the liner bottom end portion 420 of the flexible liner 400 in substantially sealed relation. In the base locking step, the base lock body 510 that is provided with the screw clamp 502 is operatively positioned about, and compresses, the liner bottom end portion 420 into said substantially sealed relation against the base top end portion 320.

In the base locking step, the helical ridge 530 extending about the upper edge portion 520 of the base lock body 510 is positioned about the exterior surface 422 of the flexible liner 400, and matingly and securely engages the mating helical groove 430 extending about the liner bottom end portion 420 in substantially sealed relation.

In the base locking step, the first bead circumscribing 318 the base top end portion 320 matingly and securely engages the second bead 518 circumscribing the base lock lower edge portion 550 of the base lock body 510 in substantially sealed relation.

In the base locking step, during movement between the proving configuration and the operative configuration, the bearing tab surface 264 of the locking tab member 260 slidably engages the base sidewall portion 302. As such, the locking tab member 260 is resiliently deformed from the default tab configuration towards the deflected tab configuration. In the operative configuration, the locking tab member 260 is in the default tab configuration. The locking tab surface 266 of the locking tab member 260 securely and matingly engages the base sidewall portion 302, so as to substantially restrain movement of the second duct 200 relative to the base tee member 300 in at least the first branch direction "F".

In the operative configuration, the stop branch member 280 of the second duct 200 securely engages the base sidewall portion 302, such as to substantially restrain movement of the second duct 200 relative to the base tee member 300 in at least the second branch direction "G" substantially opposed to the first branch direction "F".

According to the method, the base tee member 300 and the flexible liner 400 are preferably positioned within the chimney 50.

In the base tee connecting step, the base tee member 300 is connected, in fluid communication, to the second duct 200. As such, the base tee member 300 is in substantially direct downstream relation, and is adapted to vent the emissions 80, from the second duct 200 along the emission flow path "A".

In the base tee connecting step, the second duct 200 and the base tee member 300 are together moved from a proving configuration towards an operative configuration. In the proving configuration, the second duct 200 is nested within the base tee member 300. In the operative configuration, the second duct 200 securely engages and operatively extends from the base sidewall portion 302 of the base tee member 300. The base side aperture 306 through the base sidewall portion 302 is in fluid communication with, and in substantially direct downstream relation along the emission flow path "A", from the second duct 200. As such, the base tee member 300 is adapted to receive the emissions 80 from the second duct 200 through the base side aperture 306.

In the flashing insertion step, the liner top end portion 424 of the flexible liner 400 is inserted through the flashing aperture 660 of the flashing member 600. The flashing member 600 is adapted for secure engagement with the chimney 50.

In the liner top locking step, the liner top end portion 424 operatively secures to the flashing member 600. In the liner top locking step, a top lock body 820 having locking top clamp 810 is portioned about, and compresses, the secure flashing collar 630 of the flashing member 600 against the liner top end portion 424. In the liner top locking step, the upper top lip member 860 of the top lock body 820 is secured to the liner top end portion 424, with the top lock lower edge portion 870 engaging the flashing top member 600.

In the liner top locking step, top ridge 862 provided on the upper top lip member 860 extends about the top lock upper edge portion 850, and matingly and securely engages the mating top groove 440 extending about the liner top end portion 424.

In the liner top locking step, the top lock lower edge portion 870 is operatively secured to the secure flashing collar 630. The first top bead 640 at least partially circumscribes the secure flashing collar 640. The first top bead 640 matingly and securely engages the mating second top bead 840 at least partially circumscribing the top lock lower edge portion 870.

In the vent cap securing step, the outer cap surface 720 of the vent cap member 700 is positioned outside of the top lock body 820. The inner skirt 730 of the vent cap 700 engages, and extends to inside of, the liner top end portion 424. As such, the vent cap 700 is in fluid communication with, and substantially direct downstream relation along the emission flow path "A" from, the flexible liner 400. As such, the vent cap 700 is adapted to direct environmental precipitation impinging upon the vent cap 700 towards an inside 426 of the flexible liner 400 and/or across the flashing top portion 620.

In the vent cap securing step, the bendable anchor tab 744 on the top lock body 820 extends through and is bent over, so as to securely engage, the hat cap locking bracket 880 on the vent cap 700.

In the first connecting step, the first duct 100 is connected, in fluid communication, to the appliance 70. As such, the first duct 100 is adapted to vent the emissions 80 from the appliance 70 along the emission flow path "A".

As discussed hereinabove, the projecting first one 100 is preferably the first duct 100, and the socket respective other one 200 is preferably the second duct 200.

Other modifications and alterations may be used in the design and manufacture of other embodiments according to the present invention without departing from the spirit and scope of the invention, which is limited only by the accompanying claims of this application.

We claim:

1. A chimney lining apparatus for use with a chimney and emissions from an appliance, the chimney lining apparatus comprising:

a) a venting assembly comprising:

i) a first duct in fluid communication with the appliance to vent the emissions from the appliance along an emission flow path; with the first duct defining an outlet axis;

ii) a second duct positioned in said fluid communication with, and in substantially direct downstream relation along the emission flow path from, the first duct; with the second duct defining an inlet axis;

iii) a first projecting member provided with a first projection base;

iv) a mating first socket member provided with a first socket base;

wherein the first projection base securely engages a projecting first one, and the first socket base securely engages a socket respective other one, of the first duct and the second duct; and wherein each one of the first projecting member and the first socket member has a respective default configuration; and wherein at least one of the first projecting member and the first socket member is operatively designed for movement from its said default configuration towards a deflected configuration, and biased for return therefrom towards its said default configuration;

wherein the first duct and the second duct are together movable between a slidably engaging configuration and a locked configuration; wherein, in the slidably engaging configuration, the first projecting member and the first socket member bear against one another, such that said at least one of the first projecting member and the first socket member is removed from its said default configuration towards the deflected configuration; and wherein, in the locked configuration, the first projecting member and the first socket member are each in the default configuration, with the first projecting member securely and matingly engaging the first socket member, such that the second duct operatively and securely engages the first duct, with the outlet axis being substantially co-axial with the inlet axis and operatively oriented substantially along the emission flow path, to vent the emissions from the appliance downstream of the venting assembly;

b) a base tee member having a base top end portion, said base tee member operatively engaging the second duct in said fluid communication, with the base tee member being in substantially direct downstream relation along the emission flow path from the second duct;

c) a flexible liner having a liner bottom end portion and operatively engaging the base tee member in said fluid communication, with the flexible liner being in substantially direct downstream relation along the emission flow path from the base tee member; said flexible liner shaped to define a helical groove about the exterior surface of the flexible liner;

d) a liner base locking device to operatively secure the base top end portion to the liner bottom end portion in substantially sealed relation, said liner base locking device comprising a base lock upper edge portion having an upper base lip member operatively secured to the liner bottom end portion, said upper base lip member shaped to define a helical ridge facing inward; and;

a flashing member having a collar, the collar having an inner facing gripping protrusion for holding a top portion of the flexible liner;

wherein said base lock upper edge portion is operatively positioned about the exterior surface of the flexible liner, with said helical ridge matingly engaging, and being operatively secured to, said helical groove in said substantially sealed relation;

wherein each one of the base tee member and the flexible liner has a respective exterior surface, and is operatively positioned within the chimney; and wherein the emissions from the venting assembly are operatively vented, downstream along the emission flow path, through the base tee member and the flexible liner, to outside of the chimney lining apparatus.

2. An apparatus according to claim 1, wherein the liner base locking device comprises a locking clamp operatively positioned about a sealing first one of the base top end portion and the liner bottom end portion, and wherein the locking clamp operatively compresses the sealing first one, into said substantially sealed relation, against a sealing respective other one of the base top end portion and the liner bottom end portion.

3. An apparatus according to claim 2, wherein said sealing first one is the liner bottom end portion and said sealing respective other one is the base top end portion, with the locking clamp being operatively positioned about the exterior surface of the flexible liner, and with the liner bottom end portion being operatively positioned about the exterior surface of the base tee member.

4. An apparatus according to claim 2, wherein the locking clamp comprises a screw clamp.

5. An apparatus according to claim 1, wherein the liner base locking device comprises a base lock lower edge portion, with the base lock lower edge portion operatively secured to the base top end portion in said substantially sealed relation.

6. An apparatus according to claim 5, wherein the base tee member is shaped to define a first bead circumscribing the base top end portion, and the liner base locking device is shaped to define a mating second bead circumscribing the base lock lower edge portion; and wherein the base lock lower edge portion is operatively positioned about the exterior surface of the base tee member, with the first bead matingly engaging, and being operatively secured to, the second bead in said substantially sealed relation.

7. An apparatus according to claim 6, wherein the first bead extends in a substantially outward direction from an/the exterior surface of the base tee member, and wherein the liner base locking device has an interior surface, with the second bead formed as a depression in the interior surface of the liner base locking device adjacent the base lock lower edge portion.

8. An apparatus according to claim 1, wherein the base tee member has a base bottom end portion defining a base bottom aperture therethrough; and wherein the apparatus further comprises a cleanout cap operatively occluding the base bottom aperture, and a cap locking fastener to operatively secure the cleanout cap to the base bottom end portion in readily releasable relation.

9. An apparatus according to claim 8, wherein the cap locking fastener comprises a releasable joiner band operatively positioned about a securing first one of the base bottom end portion and the cleanout cap, and wherein the releasable joiner band operatively compresses the securing first one, into said readily releasable relation, against a securing respective other one of the base bottom end portion and the cleanout cap.

10. An apparatus according to claim 9, wherein said securing first one is the cleanout cap and said securing respective other one is the base bottom end portion; wherein the cleanout cap has an exterior cap surface, with the releasable joiner band being operatively positioned about the exterior cap surface.

11. An apparatus according to claim 8, further comprising a cap handle extending from the cleanout cap to facilitate ready removal of the cleanout cap from the base bottom end portion.

12. An apparatus according to claim 1, wherein the base tee member has a base sidewall portion defining a base side aperture therethrough; wherein the second duct and the base tee member are together adapted for movement between a proving configuration and an operative configuration; wherein in the proving configuration, the second duct is nested within the base tee member; and wherein in the operative configuration, said second duct securely engages and operatively extends from the base sidewall portion, with the base side aperture being in said fluid communication and in said substantially direct downstream relation along the emission flow path from the second duct, such that the emissions from the venting assembly are operatively vented, downstream along the emission flow path, from the second duct, through the base side aperture, and into the base tee member.

13. An apparatus according to claim 12, further comprising a base branch locking device to secure the second duct to the base sidewall portion in the operative configuration.

14. An apparatus according to claim 13, wherein the base branch locking device is securely attached to a first locking one, and securely engagable in the operative configuration with a respective other locking one, of the group consisting of the second duct and the base sidewall portion.

15. An apparatus according to claim 14, wherein the first locking one is the second duct, and the respective other locking one is the base sidewall portion.

16. An apparatus according to claim 14, wherein the base branch locking device comprises a resilient first locking tab member that is resiliently deformable from a first default tab configuration towards a first deflected tab configuration, and biased for resilient return therefrom towards the first default tab configuration; wherein the first locking tab member is provided with a first bearing tab surface and a first locking tab surface substantially adjacent to the first bearing tab surface; wherein during movement between the proving configuration and the operative configuration, the first bearing tab surface slidably engages the respective other locking one, such that the first locking tab member is removed from the first default tab configuration towards the first deflected tab configuration; and wherein in the operative configuration, the first locking tab member is in the first default tab configuration, and the first locking tab surface securely and matingly engages the respective other locking one, so as to substantially restrain movement of the second duct relative to the base sidewall portion in at least a first branch direction substantially parallel to the emission flow path.

17. An apparatus according to claim 16, wherein the first branch direction extends generally in the downstream direction.

18. An apparatus according to claim 16, wherein the base branch locking device further comprises a resilient second locking tab member that is resiliently deformable from a second default tab configuration towards a second deflected tab configuration, and biased for resilient return therefrom towards the second default tab configuration; wherein the second locking tab member is provided with a second bearing tab surface and a second locking tab surface substantially adjacent to the second bearing tab surface; wherein during movement between the proving configuration and the operative configuration, the second bearing tab surface slidably engages the respective other locking one, such that the second locking tab member is removed from the second default tab configuration towards the second deflected tab configuration; and wherein in the operative configuration, the second locking tab member is in the second default tab configuration, and the second locking tab surface securely and matingly engages the respective other locking one, so as to substantially restrain movement of the second duct relative to the base sidewall portion in at least the first branch direction.

19. An apparatus according to claim 16, further comprising a stop branch member provided on a first base branch one, and securely engagable in the operative configuration with a respective other base branch one, of the group consisting of the base tee member and the second duct, such that in the operative configuration, the stop branch member operatively restrains movement of the second duct relative to the base sidewall portion in at least a second branch direction substantially opposed to the first branch direction.

20. An apparatus according to claim 19, wherein the first base branch one is the second duct, and the respective other base branch one is the base tee member.

21. An apparatus according to claim 1, further comprising:

a) a flashing member securely engagable with the chimney and having a flashing top portion and an inside flashing edge shaped to define a flashing aperture through the flashing member, with the flashing top portion comprising a secure flashing collar substantially adjacent to the inside flashing edge, and with the liner top end portion extending through the flashing aperture, such that the flashing member is operatively positioned in generally downstream relation from the base tee member; and b) a liner top locking device comprising: (i) a locking top clamp operatively positioned about the secure flashing collar, and compressing the secure flashing collar against the liner top end portion; (ii) a top lock upper edge portion provided with an upper top lip member operatively secured to the liner top end portion; and (iii) a top lock lower edge portion operatively engaging the flashing top portion; such that the liner top locking device operatively secures the liner top end portion to the flashing member.

22. An apparatus according to claim 21, wherein the locking top clamp comprises a ratchet clamp.

23. An apparatus according to claim 21, wherein the top lock lower edge portion is operatively secured to the flashing top portion.

24. An apparatus according to claim 23, wherein the secure flashing collar is shaped to define a first top bead at least partially circumscribing the inside flashing edge, and the liner top locking device is shaped to define a mating second top bead at least partially circumscribing the top lock lower edge portion; and wherein the top lock lower edge portion is operatively positioned about the secure flashing collar, with the first top bead matingly engaging, and being operatively secured to, the second top bead.

25. An apparatus according to claim 24, wherein the first top bead is formed as a top projection extending in a substantially outward direction from the secure flashing collar, and wherein the liner top locking device has an interior top locking surface, with the second top bead formed as a depression in the interior top locking surface adjacent the top lock lower edge portion.

26. An apparatus according to claim 21, wherein the flashing top portion is operatively positioned substantially outside, and in substantially sealing relation with, the chimney.

27. An apparatus according to claim 21, further comprising a vent cap having an upper shield, an outer cap surface operatively positioned outside of the liner top locking device, and an inner skirt operatively engaging, and extending to inside of, the liner top end portion; wherein the vent cap is in said fluid communication and in substantially direct downstream relation along the emission flow path from the flexible liner; wherein the upper shield partially shields a top emission outlet in the liner top end portion from environmental precipitation and permits the emissions to be operatively vented, through the vent cap, to outside of the chimney and chimney lining apparatus; and wherein the precipitation impinging upon the vent cap is operatively substantially directed towards at least one of an inside of the flexible liner and across the flashing top portion.

28. An apparatus according to claim 27, further comprising a projecting cap locking member provided on a first cap locking one, and a mating socket cap locking member provided on a respective other cap locking one, of the vent cap and the liner top locking device; wherein the projecting cap locking member is operatively secured to the mating socket cap locking member, such that the vent cap is operatively secured to the liner top locking device.

29. An apparatus according to claim 28, wherein the projecting cap locking member comprises a bendable anchor tab, and the mating socket cap locking member comprises a hat cap locking bracket, wherein the bendable anchor tab extends through and is bent over, so as to securely engage, the hat cap locking bracket.

30. An apparatus according to claim 28, wherein the first cap locking one is the vent cap, and the respective other cap locking one is the liner top locking device.

31. A method of venting emissions from an appliance comprising the steps of:

a first connecting step of connecting, in fluid communication, a first duct to the appliance, such that the first duct is adapted to vent the emissions from the appliance along an emission flow path;

a second connecting step of connecting, in said fluid communication, a second duct to the first duct, such that the second duct is in substantially direct downstream relation, and is adapted to vent the emissions, from the first duct along the emission flow path;

wherein, before the second connecting step, a first projection base of a first projecting member securely engages a projecting first one, and a first socket base of a mating first socket member securely engages a socket respective other one, of the first duct and the second duct;

wherein, before the second connecting step, each one of the first projecting member and the first socket member is in a respective default configuration;

wherein the method further comprises a first pre-assembly step, before the second connecting step, of making at least one of the first projecting member and the first socket member movable from its said default configuration towards a deflected configuration, and biased for return therefrom towards its said default configuration;

wherein, in the second connecting step, the first duct and the second duct together move from a slidably engaging configuration towards a locked configuration;

wherein in the slidably engaging configuration, the first projecting member and the first socket member bear against one another, such that said at least one of the first projecting member and the first socket member is removed from its said default configuration towards the deflected configuration; and wherein, in the locked configuration, the first projecting member and the first socket member are each in the default configuration, with the first projecting member securely and matingly engaging the first socket member, such that the second duct operatively and securely engages the first duct, with an outlet axis of the first duct being substantially co-axial with an inlet axis of the second duct and operatively oriented substantially along the emission flow path, to vent the emissions from the appliance downstream of the second duct;

wherein a base tee member and a flexible liner are positioned within a chimney, with the method further comprising the steps of:

a base tee connecting step, before the first connecting step, of connecting, in said fluid communication, the base tee member to the second duct, such that the base tee member is in said substantially direct downstream relation, and is adapted to vent the emissions, from the second duct along the emission flow path;

a liner connecting step of connecting, in said fluid communication, the flexible liner to the base tee member, such that the flexible liner is in said substantially direct downstream relation, and is adapted to vent the emissions, from the base tee member along the emission flow path, a base locking step of securing a base top end portion of the base tee member to a liner bottom end portion of the flexible liner in substantially sealed relation;

wherein, in the base locking step, a base lock body provided with a screw clamp is operatively positioned about and compresses the liner bottom end portion, into said substantially sealed relation, against the base top end portion and a helical ridge extending inward about an upper edge portion of the base lock body is positioned about an exterior surface of the flexible liner, and matingly and securely engages a mating helical groove extending about the liner bottom end portion in said substantially sealed relation, and;

a flashing connecting step comprising clamping a collar attached to a flashing member to a top portion of the flexible liner wherein a protrusion on the inner surface of the collar grips the flexible liner.

32. A method according to claim 31, wherein the second connecting step is performed before the first connecting step.

33. A method according to claim 31, wherein the liner connecting step is performed before the base tee connecting step.

34. A method according to claim 31, wherein in the base locking step, a first bead circumscribing the base top end portion matingly and securely engages a second bead circumscribing a base lock lower edge portion of the base lock body in said substantially sealed relation.

35. A method according to claim 31, wherein in the base tee connecting step, the second duct and the base tee member are together moved from a proving configuration towards an operative configuration;

wherein in the proving configuration, the second duct is nested within the base tee member; and wherein in the operative configuration, the second duct securely engages and operatively extends from a base sidewall portion of the base tee member, with a base side aperture through the base sidewall portion being in said fluid communication and in said substantially direct downstream relation along the emission flow path from the second duct, such that the base tee member is adapted to receive the emissions from the second duct through the base side aperture.

36. A method according to claim 35, wherein, before the base locking step, a resilient locking tab member is securely attached to the second duct, with the locking tab member being in a default tab configuration;

wherein the method further comprises a tab pre-assembly step, before the base locking step, of making the locking tab resiliently deformable from the default tab configuration towards a deflected tab configuration, and biased for resilient return therefrom towards the default tab configuration; and wherein, in the base locking step:

during movement between the proving configuration and the operative configuration, a bearing tab surface of the locking tab member slidably engages the base sidewall portion, such that the locking tab member is resiliently deformed from the default tab configuration towards the deflected tab configuration; and in the operative configuration, the locking tab member is in the default tab configuration, and a locking tab surface of the locking tab member securely and matingly engages the base sidewall portion, so as to substantially restrain movement of the second duct relative to the base tee member in at least a first branch direction.

37. A method according to claim 36, wherein in the operative configuration, a stop branch member of the second duct securely engages the base sidewall portion, such as to substantially restrain movement of the second duct relative to the base tee member in at least a second branch direction substantially opposed to the first branch direction.

38. A method according to claim 31, further comprising the steps of:

a flashing insertion step of inserting a liner top end portion of the flexible liner through a flashing aperture of a flashing member, with the flashing member adapted for secure engagement with the chimney; and a liner top locking step of operatively secures the liner top end portion to the flashing member;

wherein, in the liner top locking step, a top lock body provided with a locking top clamp is portioned about and compresses a secure flashing collar of the flashing member against the liner top end portion; and wherein, in the liner top locking step, an upper top lip member of the top lock body is secured to the liner top end portion, with a top lock lower edge portion engaging the flashing top member.

39. A method according to claim 38, wherein in the liner top locking step, a top ridge provided on the upper top lip member extends about the top lock upper edge portion, and matingly and securely engages a mating top groove extending about the liner top end portion.

40. A method according to claim 38, wherein in the liner top locking step, the top lock lower edge portion is operatively secured to the secure flashing collar, with a first top bead at least partially circumscribing the secure flashing collar, and with the first top bead matingly and securely engaging a mating second top bead at least partially circumscribing the top lock lower edge portion.

41. A method according to claim 38, further comprising a vent cap securing step of positioning an outer cap surface of a vent cap member outside of the top lock body;

wherein, in the vent cap securing step, an inner skirt of the vent cap engages, and extends to inside of, the liner top end portion;

such that the vent cap is in said fluid communication and in said substantially direct downstream relation along the emission flow path from the flexible liner; and such that the vent cap is adapted to direct environmental precipitation impinging upon the vent cap towards at least one of an inside of the flexible liner and across the flashing top portion.

42. A method according to claim 41, wherein in the vent cap securing step, a bendable anchor tab provided on the top lock body extends through and is bent over, so as to securely engage, a hat cap locking bracket provided on the vent cap.

43. A method according to claim 31, wherein in the second connecting step, an anchor member of the first projecting member extends at least partially through, and into secure engagement with, a hat bracket of the first socket member.

44. A method according to claim 31, wherein, in the second connecting step, a movable portion of the first projecting member moves, relative to the projection base, between the default configuration and the deflected configuration;

wherein, in the slidably engaging configuration, a bearing surface of the movable portion slidably engages the first socket member, such that the movable portion is removed from the default configuration towards the deflected configuration; and wherein, in the locked configuration, the movable portion is in the default configuration, and a locking surface of the first projecting member securely and matingly engages the first socket member, so as to restrain movement of the first socket member relative to the first projecting member in at least a first restraining direction.

45. A method according to claim 44, further comprising a projection pre-assembly step, before the second connecting step, of making the movable portion resiliently deformable from the default configuration towards the deflected configuration, and biased for resilient return therefrom towards its said default configuration.

46. A method according to claim 45, wherein in the locked configuration of the second connecting step, a stop member provided on the projecting first one engages the socket respective other one, so as to restrain movement of the first socket member relative to the first projecting member in at least a second restraining direction substantially opposed to the first restraining direction.

47. A method according to claim 31, wherein, before the second connecting step, a second projection base of a second projecting member securely engages the projecting first one, and a second socket base of a mating second socket member securely engages the socket respective other one;

wherein, before the second connecting step, each one of the second projecting member and the second socket member is in the default configuration;

wherein, in the first pre-assembly step, at least one of the second projecting member and the second socket member is made movable from its said default configuration towards its said deflected configuration, and biased for return therefrom towards its said default configuration;

wherein in the slidably engaging configuration, the second projecting member and the second socket member bear against one another, such that said at least one of the second projecting member and the second socket member is removed from its said default configuration towards the deflected configuration; and wherein, in the locked configuration, the second projecting member and the second socket member are each in the default configuration, with the second projecting member securely and matingly engaging the second socket member.

48. A method according to claim 31, wherein the projecting first one is the first duct, and the socket respective other one is the second duct.

* * * * *